US007575292B2

(12) United States Patent
Furukawa

(10) Patent No.: US 7,575,292 B2
(45) Date of Patent: Aug. 18, 2009

(54) PRINTHEAD HAVING DIGITAL CIRCUIT AND ANALOG CIRCUIT, AND PRINTING APPARATUS USING THE SAME

(75) Inventor: Tatsuo Furukawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 555 days.

(21) Appl. No.: 11/515,826

(22) Filed: Sep. 6, 2006

(65) Prior Publication Data

US 2007/0002340 A1 Jan. 4, 2007

Related U.S. Application Data

(62) Division of application No. 09/940,490, filed on Aug. 29, 2001, now Pat. No. 7,133,153.

(30) Foreign Application Priority Data

Aug. 31, 2000 (JP) ..... 2000-264253

(51) Int. Cl.
*B41J 29/393* (2006.01)
*B41J 29/38* (2006.01)

(52) U.S. Cl. ..... 347/5; 347/19

(58) Field of Classification Search ..... 347/5, 347/19

See application file for complete search history.

(56) References Cited

U.S. PATENT DOCUMENTS

| | | | |
|---|---|---|---|
| 4,313,124 | A | 1/1982 | Hara |
| 4,345,262 | A | 8/1982 | Shirato et al. |
| 4,459,600 | A | 7/1984 | Sato et al. |
| 4,463,359 | A | 7/1984 | Ayata et al. |
| 4,558,333 | A | 12/1985 | Sugitani et al. |
| 4,723,129 | A | 2/1988 | Endo et al. |
| 4,740,796 | A | 4/1988 | Endo et al. |
| 5,121,135 | A | 6/1992 | Deguchi et al. |
| 5,163,063 | A | 11/1992 | Yoshikawa et al. |
| 5,281,980 | A | 1/1994 | Kishida et al. |
| 5,635,968 | A | 6/1997 | Bhaskar et al. |
| 5,742,307 | A | 4/1998 | Watrobski et al. |
| 5,745,130 | A | 4/1998 | Becerra et al. |
| 5,764,246 | A | 6/1998 | Wataya et al. |
| 6,068,363 | A | 5/2000 | Saito |

(Continued)

FOREIGN PATENT DOCUMENTS

| | | |
|---|---|---|
| EP | 0 980 758 | 2/0000 |

(Continued)

*Primary Examiner*—Julian D Huffman
(74) *Attorney, Agent, or Firm*—Fitzpatrick, Cella, Harper & Scinto

(57) ABSTRACT

In a printhead having an element substrate on which a digital circuit including a printing element and a drive circuit for driving the printing element in accordance with input print data, and an analog circuit including a detection circuit for obtaining information, a voltage generation circuit for generating the voltage for driving the analog circuit when the value of the voltage for driving the digital circuit is different from that of the analog circuit is arranged on the element substrate, and when the voltage for driving the digital circuit is actually different from that of the analog circuit, only the voltage for driving the digital circuit is externally supplied except a power supply voltage for the printing element, thereby simplifying the overall arrangement.

14 Claims, 19 Drawing Sheets

U.S. PATENT DOCUMENTS

| | | | |
|---|---|---|---|
| 6,070,959 | A | 6/2000 | Kanbayashi et al. |
| 6,091,351 | A | 7/2000 | Shimomura |
| 6,177,815 | B1 | 1/2001 | Baumgartner et al. |
| 6,293,655 | B1 | 9/2001 | Imanaka et al. |
| 6,334,660 | B1 | 1/2002 | Holstun et al. |
| 6,435,668 | B1 | 8/2002 | Barbour et al. |
| 6,464,318 | B2 | 10/2002 | Kubo |
| 6,575,548 | B1 | 6/2003 | Corrigan et al. |
| 6,601,941 | B1 | 8/2003 | Jones et al. |
| 6,708,279 | B1 | 3/2004 | Takenaka |
| 7,129,985 | B1 | 10/2006 | Koizumi et al. |

FOREIGN PATENT DOCUMENTS

| | | |
|---|---|---|
| EP | 0 532 877 | 8/1992 |
| EP | 0 816 082 | 1/1998 |
| JP | 54-56847 | 5/1979 |
| JP | 59-123670 | 7/1984 |
| JP | 59-138461 | 8/1984 |
| JP | 60-71260 | 4/1985 |
| JP | 4-10677 | 1/1992 |
| JP | 7-52387 | 2/1995 |
| JP | 9-52407 | 2/1997 |
| JP | 9-174852 | 7/1997 |
| JP | 11-205140 | 7/1999 |
| JP | 11-227209 | 8/1999 |
| JP | 11-251448 | 9/1999 |
| JP | 2000-224495 | 8/2000 |

PRINTHEAD HAVING DIGITAL CIRCUIT AND ANALOG CIRCUIT, AND PRINTING APPARATUS USING THE SAME

This is a divisional application of application Ser. No. 09/940,490, filed on Aug. 29, 2001, now allowed.

FIELD OF THE INVENTION

The present invention relates to a printhead and a printing apparatus using the printhead and, more particularly, to a printhead having an element substrate on which a digital circuit including a printing element and a drive means for driving the printing element in accordance with input print data, and an analog circuit including a detection means for detecting information related to printing (information related to the substrate state) are formed by a semiconductor process, and a printing apparatus using the printhead.

The present invention is applicable not only to a general printing apparatus but also to an apparatus such as a copying machine, a facsimile apparatus with a communication system, or a wordprocessor with a printing unit, and an industrial printing apparatus combined with various processing apparatuses.

BACKGROUND OF THE INVENTION

In a conventional printing apparatus according to an inkjet scheme using thermal energy, the electrothermal transducer (heater) and a drive circuit therefor in a mounted printhead are formed on a single substrate using a semiconductor process, as disclosed in, e.g., EP A2 532877. A technique of forming, on the same substrate, an element for detecting substrate states such as a substrate temperature, resistance value distribution state, and a variation in characteristic of the drive circuit has also been proposed.

As an example in which a circuit block for detecting a substrate temperature is formed on a single substrate, EP 0980758 A proposes a printhead with a circuit formed on an element substrate, which outputs temperature information as a digital signal. In the circuit arrangement formed on the element substrate, digital circuits such as an inverter or a shift-register and analog circuits such as a comparator are mixed.

Components used for these analog circuits are generally designed for use at a power supply voltage of 5 V to sufficiently exhibit its characteristic. However, an inverter or shift register is a digital circuit and basically operates in accordance with a Hi/Lo pulse. An application pulse for a print information interface of the printhead or heater drive is also a digital signal. Signal transmission/reception to/from an external device is done in accordance with a Hi/Lo logic pulse.

Conventionally, the amplitude of a logic pulse used in these circuits and external signal generation circuits is generally 0 V/5 V. As a result, a single power supply voltage of 5V can be used for both the analog circuits and the digital circuits.

Recently, micropatterning for an MPU (microprocessor) or gate array manufactured by a semiconductor process is becoming more popular, and the power supply voltage to be used also tends to be lower. Even for a digital circuit used in an external signal generation unit of a printhead, a power supply voltage of 3.3 V is becoming popular in recent years.

Consequently, a demand has arisen for a semiconductor substrate for a printhead, which has power supply voltage as low as 3.3 V. A digital circuit portion can be driven at a low voltage by, e.g., micropatterning a transistor in the circuit. However, for an analog circuit portion, it is difficult to reduce the drive voltage without changing the circuit arrangement. To reduce the drive voltage of an analog circuit, the circuit must be re-designed. In addition, use of a specific component is also necessary to prevent the characteristic from degrading.

For this reason, in a case where the power supply voltage for the digital circuit is made to 3,3V, a digital circuit uses a power supply voltage of 3.3 V, and an analog circuit uses a power supply voltage of 5 V. Since different power supply voltages are required, the semiconductor substrate of a printhead should be designed to receive two types of power supply voltages from external circuits. This increases the cost and complexes the system configuration, resulting in disadvantages from the viewpoint of space saving or energy saving (power consumption).

SUMMARY OF THE INVENTION

It is an object of the present invention to provide a printhead which can simplify the overall arrangement when the voltage for driving a digital circuit and the voltage for driving an analog circuit (such as an analog circuit for obtaining information on the temperature etc.), except a power supply voltage for a printing element, are different, by supplying only the power supply voltage of the digital circuit from an external circuit, and a printing apparatus using the printhead.

The above object is achieved by a printhead of the present invention, which comprises an element substrate having a digital circuit and analog circuit formed thereon, the digital circuit including a printing element and drive means for driving the printing element in accordance with input print data, and the analog circuit including detection means for obtaining information, wherein a value of a voltage for driving the digital circuit is different from a value of a voltage for driving the analog circuit, and a voltage generation circuit for generating the voltage for driving the analog circuit is arranged on the element substrate.

The object of the present invention is also achieved by a printing apparatus having the printhead.

That is, in the present invention, in a printhead having an element substrate on which a digital circuit including a printing element and drive means for driving the printing element in accordance with input print data, and an analog circuit including detection means for obtaining information are formed, when the value of the voltage for driving the digital circuit is different from that of the analog circuit, a voltage generation circuit for generating the voltage for driving the analog circuit is arranged on the element substrate.

With this arrangement, as compared to a case wherein both the voltages of the digital circuit and that of the analog circuit for obtaining information are externally supplied, only the voltage of the digital circuit need be externally supplied, except a power supply voltage for a printing element, and therefore, the arrangement can be simplified without increasing the cost of the entire system, and an advantageous arrangement can be obtained from the viewpoint of space saving or energy saving (power consumption).

When a capacitor having one terminal connected to the power supply voltage of the analog circuit and the other terminal grounded is arranged outside the element substrate, the influence of noise generated in the power supply voltage of the analog circuit due to the digital circuit or heater driving can be reduced.

The voltage generation circuit preferably generates the voltage for driving the analog circuit from a voltage for driving the printing element.

The voltage generation circuit preferably comprises a dividing resistor and a transistor, or a noninverting amplifier.

The digital circuit preferably comprises a shift register for temporarily storing the print data and a latch for holding the data stored in the shift register, and the analog circuit for obtaining the information preferably comprises detection means for detecting an external temperature of the element substrate or detection means for monitoring a heater resistance value.

The detection means preferably comprises a temperature detection circuit for detecting the temperature of the element substrate.

The digital circuit preferably comprises a memory for storing at least one of pieces of information related to the resistance value of an electrothermal transducer, the resistance value upon operation of the drive means, and the thickness of each layer of the element substrate.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In the embodiments to be explained below, a printing apparatus using an inkjet printing system will be described by taking a printer as an example.

In this specification, "print" is not only to form significant information such as characters and graphics but also to form, e.g., images, figures, and patterns on printing media in a broad sense, regardless of whether the information formed is significant or insignificant or whether the information formed is visualized so that a human can visually perceive it, or to process printing media.

"Printing media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

An "substrate" (to be also referred to as an "element board" hereinafter) includes not only a base plate made of a silicon semiconductor but also a base plate bearing elements and wiring lines.

The following expression "on an substrate" means "the surface of an substrate" or "the inside of an substrate near its surface" in addition to "on an substrate". "Built-in" in the present invention does not represent a simple layout of separate elements on a base, but represents integral formation/manufacture of elements on an substrate by a semiconductor circuit manufacturing process.

[Apparatus Main Body]

Figure 1:
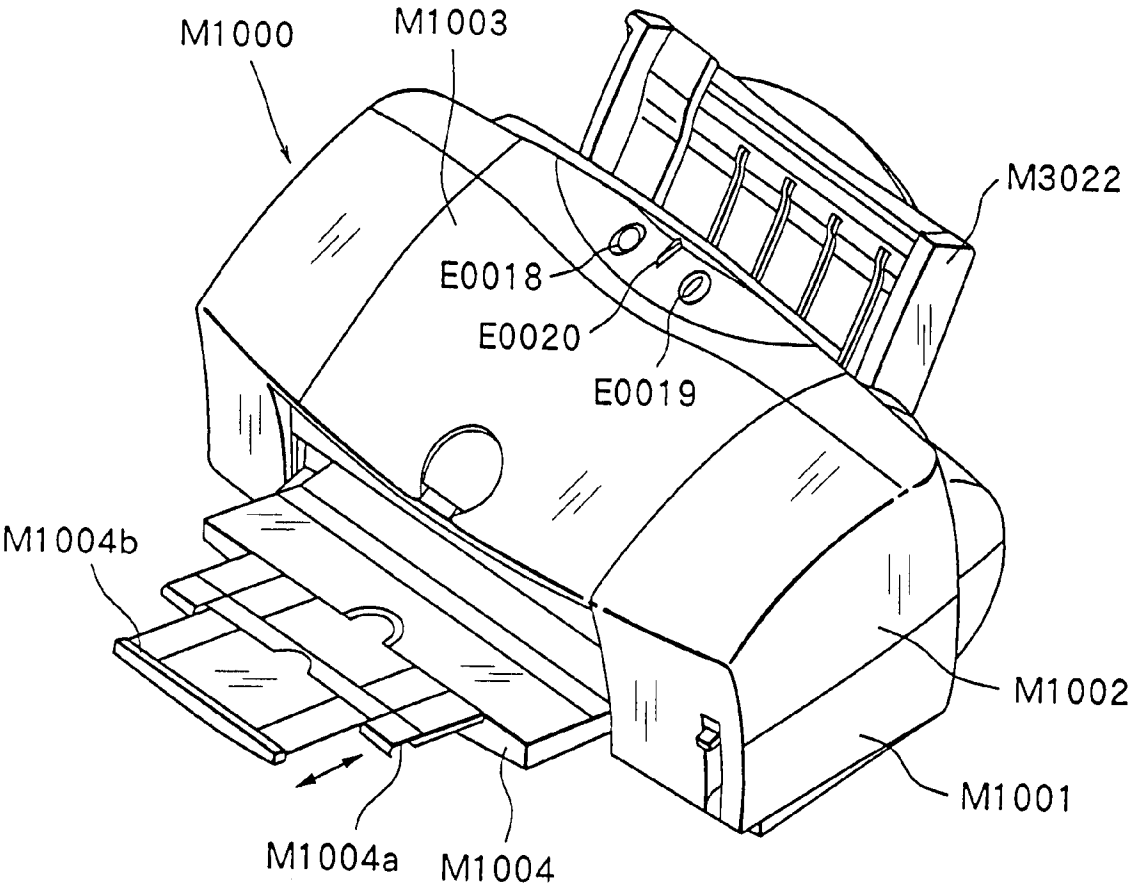
FIG. 1 is a perspective view showing the external appearance of an inkjet printer according to an embodiment of the present invention.
Figure 2:
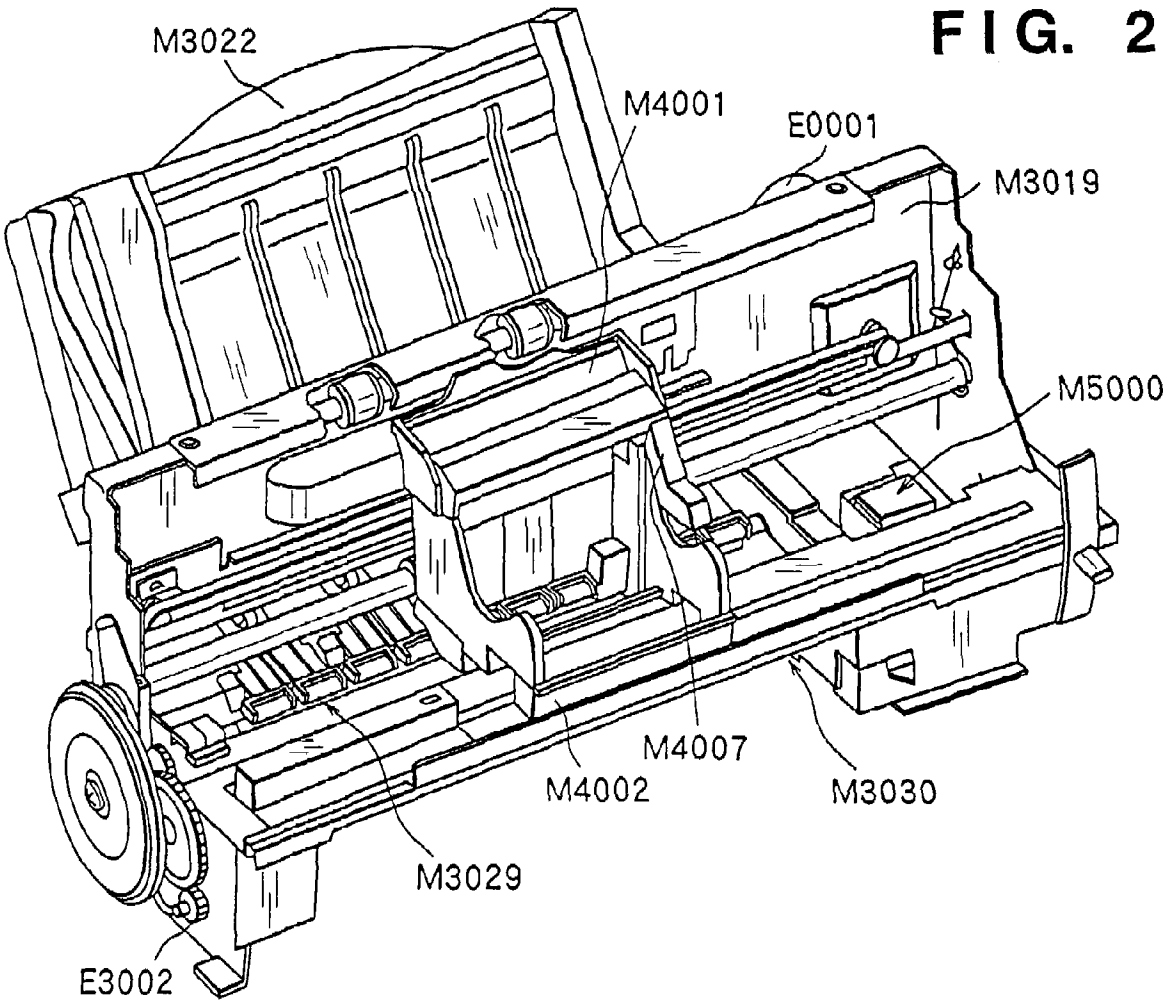
FIG. 2 is a perspective view showing the state in which external parts of the printer shown in FIG. 1 are removed.

FIGS. 1 and 2 show an outline of the arrangement of a printer using an inkjet printing system. Referring to FIG. 1, an apparatus main body M1000 as a shell of the printer according to this embodiment is composed of external members, i.e., a lower case M1001, upper case M1002, access cover M1003, and delivery tray M1004, and a chassis M3019 (FIG. 2) accommodated in these external members.

The chassis M3019 is made of a plurality of plate-like metal members having predetermined stiffness, forms a framework of the printing apparatus, and holds various printing mechanisms to be described later.

The lower case M1001 forms a substantially lower half of the apparatus main body M1000, and the upper case M1002 forms a substantially upper half of the apparatus main body M1000. The combination of these two cases forms a hollow structure having a housing space for housing diverse mechanisms to be described later. Openings are formed in the top surface and the front surface of this hollow structure.

One end portion of the delivery tray M1004 is rotatably held by the lower case M1001. By rotating this delivery tray M1004, the opening formed in the front surface of the lower case M1001 can be opened and closed. When printing is to be executed, therefore, the delivery tray M1004 is rotated forward to open the opening to allow printing sheets to be delivered from this opening, and delivered printing sheets P can be stacked in order. Also, the delivery tray M1004 accommodates two auxiliary trays M1004*a* and M1004*b*. By pulling each tray forward as needed, the sheet support area can be increased and reduced in three steps.

One end portion of the access cover M1003 is rotatably held by the upper case M1002. This allows this access cover M1003 to open and close the opening formed in the top surface of the upper case M1002. By opening this access cover M1003, a printhead cartridge H1000 or an ink tank H1900 housed inside the main body can be replaced. Although not shown, when the access cover M1003 is opened or closed, a projection formed on the rear surface of this access cover M1003 rotates a cover opening/closing lever. A microswitch or the like detects the rotated position of this lever. In this way, the open/closed state of the access cover can be detected.

Figure 7:
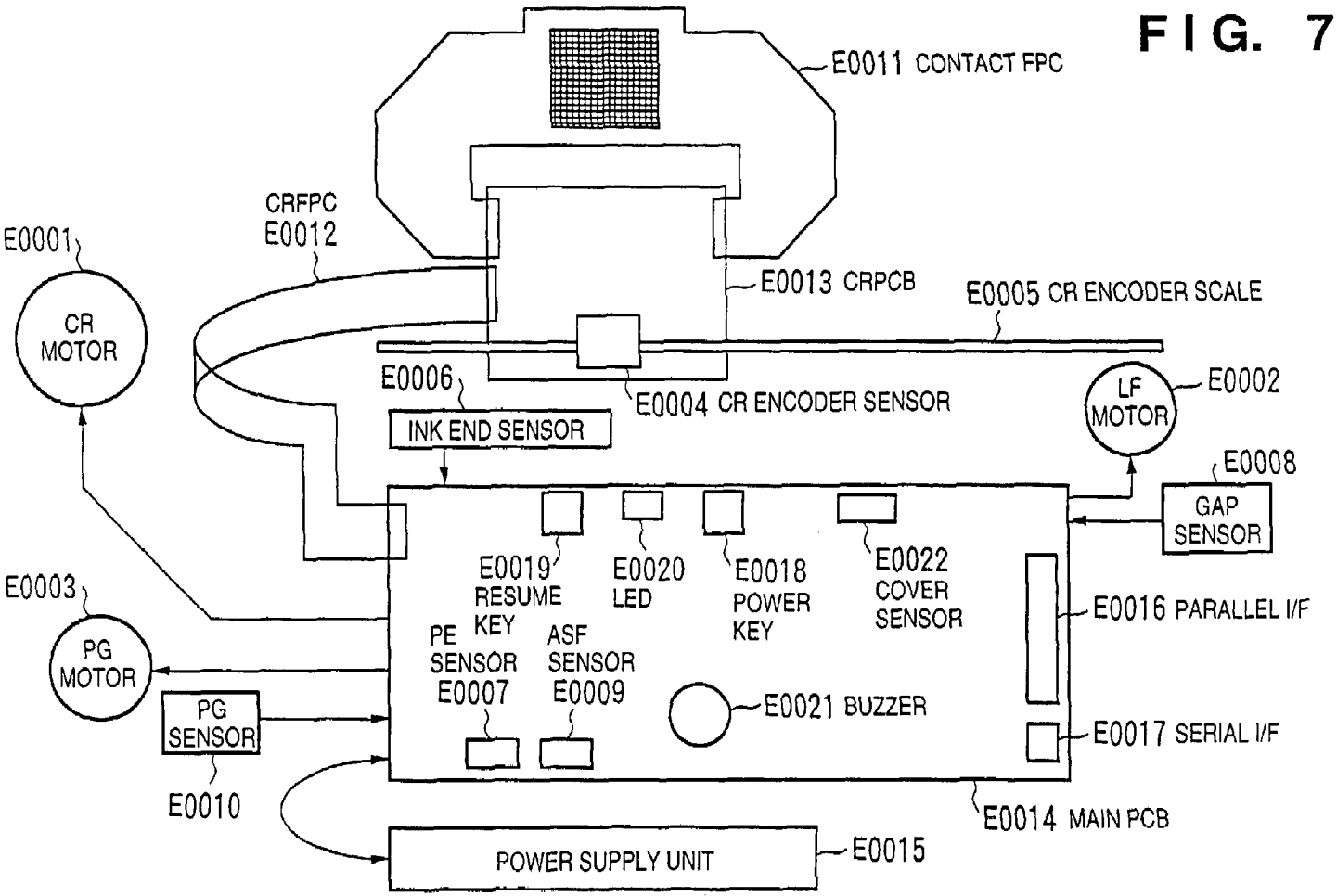
FIG. 7 is a block diagram schematically showing the overall arrangement of an electronic circuit in the embodiment of the present invention.

On the top surface in the rear portion of the upper case M1002, a power key E0018 and a resume key E0019 are arranged to be able to be pressed, and an LED E0020 is also arranged. When the power key E0018 is pressed, the LED E0020 is turned on to inform the operator that printing is possible. This LED E0020 has various display functions, e.g., informs the operator of a trouble of the printer by changing the way the LED E0020 turns on and off, changing the color of light, or sounding a buzzer E0021 (FIG. 7). When the trouble is solved, printing is restarted by pressing the resume key E0019.

[Printing Mechanisms]

Printing mechanisms of this embodiment housed in and held by the apparatus main body M1000 of the above printer will be described below.

The printing mechanisms according to this embodiment are: an automatic feeder M3022 for automatically feeding the printing sheets P into the apparatus main body; a conveyor unit M3029 for guiding the printing sheets P fed one by one from the automatic feeder to a desired printing position and guiding these recording sheets P from the printing position to a delivery unit M3030; a printing unit for performing desired printing on each printing sheet P conveyed by the conveyor unit M3029; and a recovery unit (M5000) for recovering, e.g., the printing unit.

(Printing Unit)

The printing unit will be described below.

This printing unit includes a carriage M4001 movably supported by a carriage shaft M4021, and the printhead cartridge H1000 detachably mounted on this carriage M4001.

(Printhead Cartridge)

First, the printhead cartridge will be described with reference to FIGS. 3 to 5.

Figure 3:
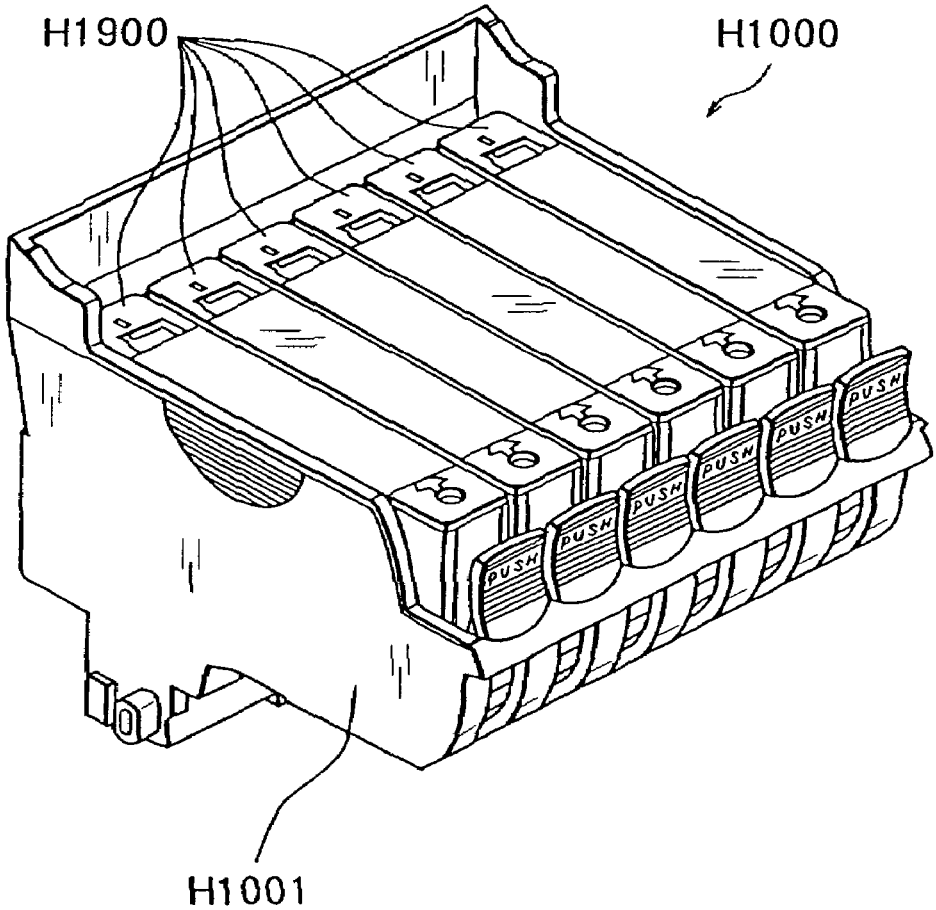
FIG. 3 is an exploded perspective view showing a printhead cartridge used in the embodiment of the present invention.
Figure 4:
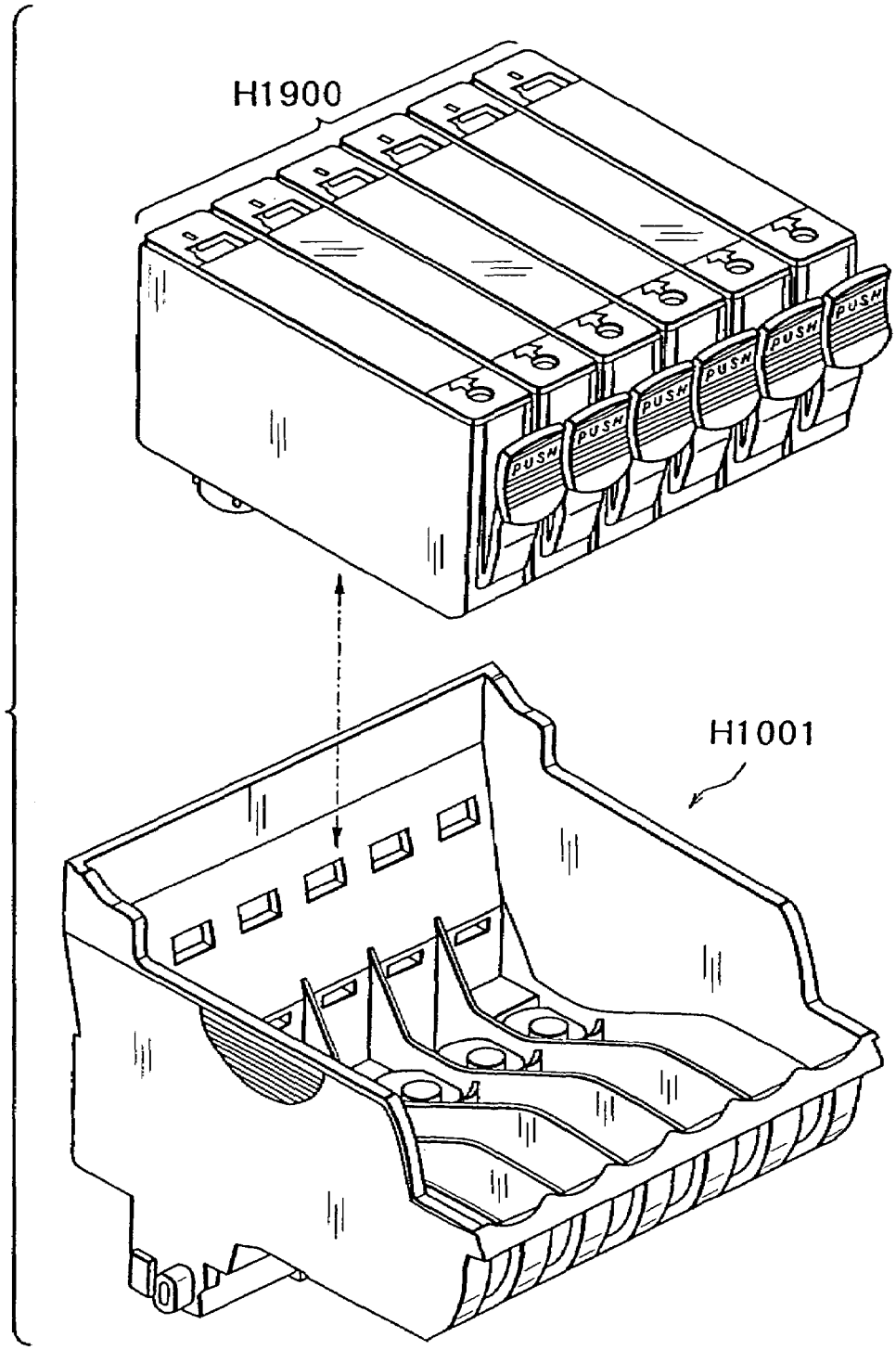
FIG. 4 is a side view showing the state in which the printhead cartridge shown in FIG. 3 is assembled.

As shown in FIG. 3, the printhead cartridge H1000 of this embodiment has the ink tank H1900 containing ink and a printhead H1001 for discharging the ink supplied from this ink tank H1900 from nozzles in accordance with printing information. This printhead H1001 is of a so-called cartridge type detachably mounted on the carriage M4001 (to be described later).

To make photographic high-quality color printing feasible, the printhead cartridge H1000 of this embodiment includes independent color ink tanks, e.g., black, light cyan, light magenta, cyan, magenta, and yellow ink tanks. As shown in FIG. 4, these ink tanks can be independently attached to and detached from the printhead H1001.

Figure 5:
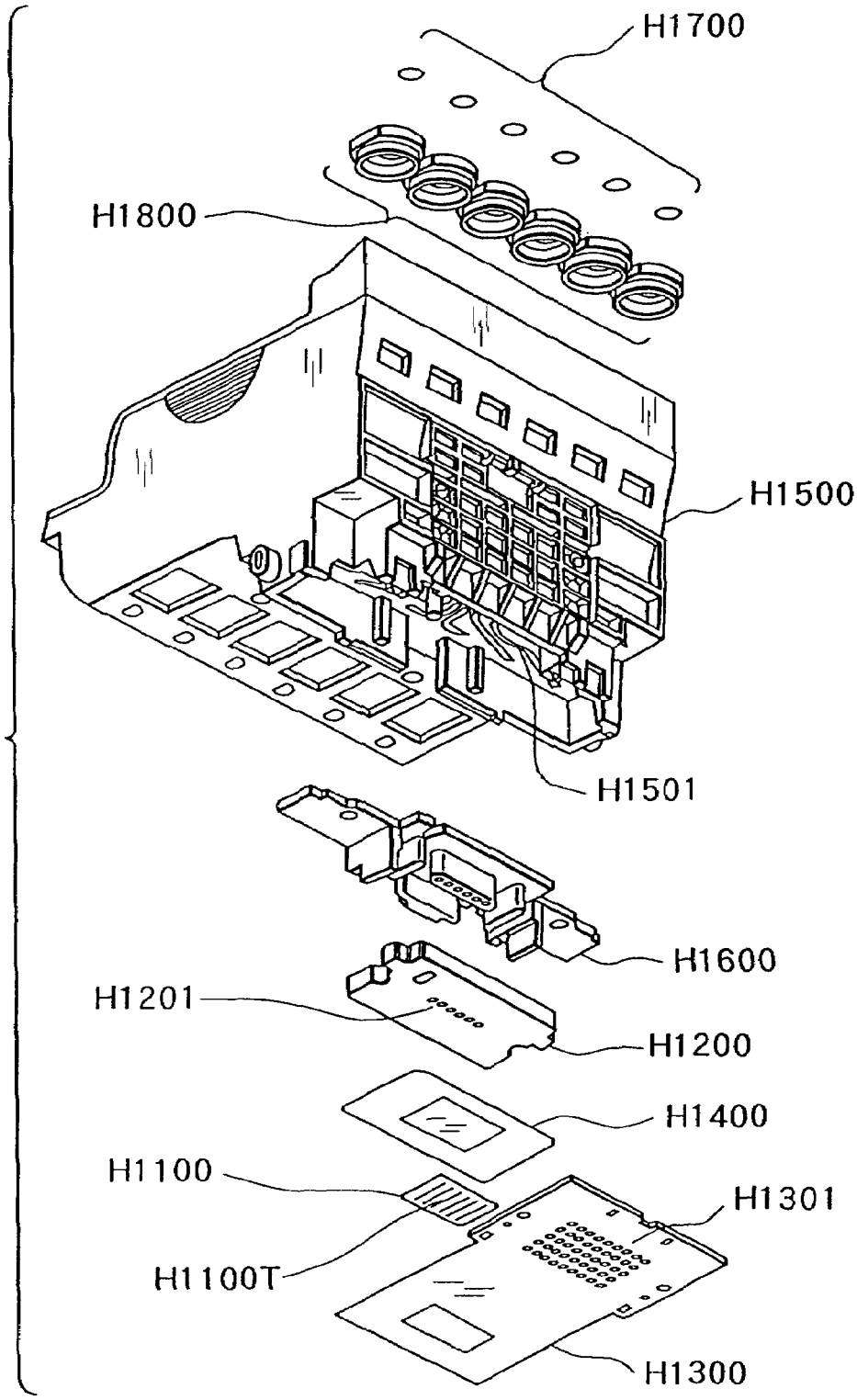
FIG. 5 is a perspective view showing the printhead of FIG. 4 when obliquely viewed from below.

As shown in an exploded perspective view of FIG. 5, the printhead H1001 comprises a printing element board H1100, first plate H1200, electrical printed circuit board H1300, second plate H1400, tank holder H1500, channel forming member H1600, filters H1700, and sealing rubber members H1800.

On the printing element board H1100, a plurality of printing elements for discharging ink and electric lines made of, e.g., Al for supplying electric power to these printing elements are formed on one surface of an Si substrate by film formation technologies. A plurality of ink channels and a plurality of discharge orifices H1100T corresponding to the printing elements are formed by photolithography. Also, ink supply openings for supplying ink to these ink channels are formed in the rear surface. This printing element board H1100 is fixed to the first plate H1200 by adhesion. Ink supply openings H1201 for supplying ink to the printing element board H1100 are formed in this first plate H1200. Furthermore, the second plate H1400 having an opening is fixed to the first plate H1200 by adhesion. This second plate H1400 holds the electric printed circuit board 1300 such that the electric printed circuit board H1300 and the printing element board H1100 are electrically connected.

This electric printed circuit board H1300 applies an electrical signal for discharging ink to the printing element board H1100. The electric printed circuit board H1300 has electric lines corresponding to the printing element board H1100, and external signal input terminals H1301 formed in end portions of these electric lines to receive electrical signals from the main body. The external signal input terminals H1301 are positioned and fixed at the back of the tank holder H1500.

The channel forming member H1600 is ultrasonically welded to the tank holder H1500 for detachably holding the ink tanks H1900, thereby forming ink channels H1501 from the ink tanks H1900 to the first plate H1200. Also, the filters H1700 are formed at those end portions of the ink channels H1501, which engage with the ink tanks H1900, to prevent invasion of dust from the outside. The sealing rubber members H1800 are attached to the portions engaging with the ink tanks H1900 to prevent evaporation of ink from these engaging portions.

Furthermore, the printhead H1001 is constructed by bonding, by an adhesive or the like, a tank holder unit composed of the tank holder H1500, channel forming member H1600, filters H1700, and sealing rubber members H1800 to a printing element unit composed of the printing element board H1100, first plate H1200, electric printed circuit board H1300, and second plate H1400.

(Carriage)

The carriage M4001 will be described below with reference to FIG. 2.

As shown in FIG. 2, this carriage M4001 includes a carriage cover M4002 and head set lever M4007. The carriage cover M4002 engages with the carriage M4001 and guides the printhead H1001 to the mount position of the carriage M4001. The head set lever M4007 engages with the tank holder H1500 of the printhead H1001 and pushes the printhead H1000 such that the printhead H1000 is set in a predetermined mount position.

That is, the head set lever M4007 is set in the upper portion of the carriage M4001 so as to be pivotal about a head set level shaft. Also, a head set plate (not shown) is set via a spring in a portion which engages with the printhead H1001. By the force of this spring, the printhead H1001 is pushed and mounted on the carriage M4001.

A contact flexible print cable (to be referred to as a contact FPC hereinafter) E0011 is set in another engaging portion of the carriage M4001 with respect to the printhead H1001. Contact portions E0011*a* on this contact FPC E0011 and the contact portions (external signal input terminals) H1301 formed on the printhead H1001 electrically contact each other to exchange various pieces of information for printing or supply electric power to the printhead H1001.

An elastic member (not shown) made of, e.g., rubber is formed between the contact portions E0011*a* of the contact FPC E0011 and the carriage M4001. The elastic force of this elastic member and the biasing force of the head set lever spring make reliable contact between the contact portions E0011*a* and the carriage M4001 possible. Furthermore, the contact FPC E0011 is connected to a carriage printed circuit board E0013 mounted on the back surface of the carriage M4001 (FIG. 7).

[Scanner]

The printer of this embodiment is also usable as a reading apparatus by replacing the printhead with a scanner.

This scanner moves together with the carriage of the printer and reads an original image supplied instead of a printing medium in a sub-scan direction. Information of one original image is read by alternately performing the read operation and the original feed operation.

Figure 6B:
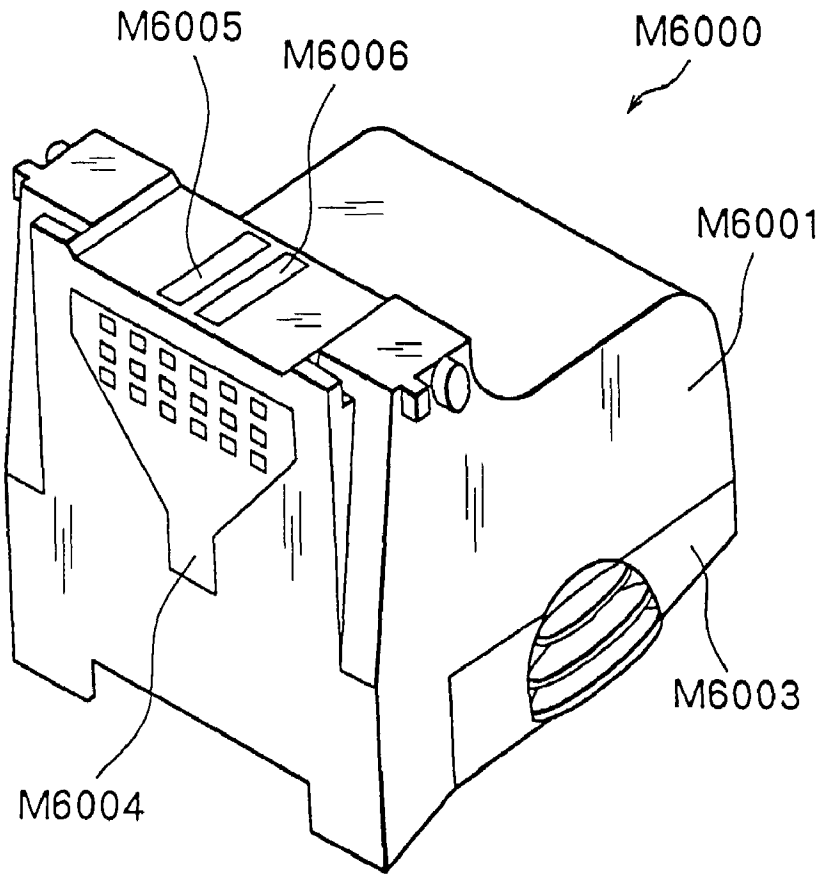
FIGS. 6A and 6B are perspective views showing a scanner cartridge in the embodiment of the present invention.
Figure 6A:
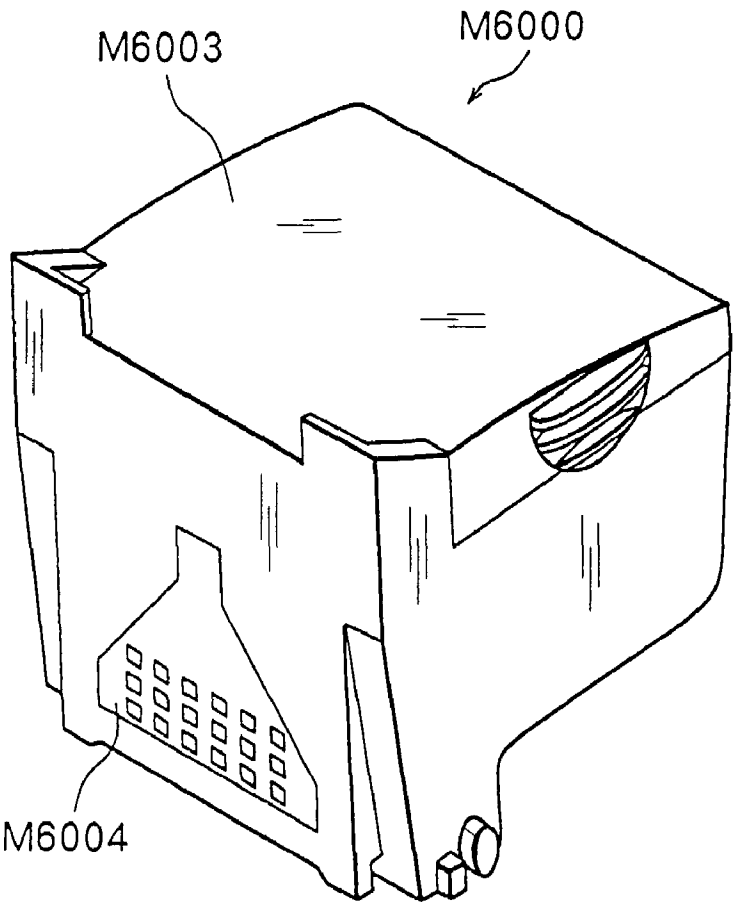

FIGS. 6A and 6B are views showing an outline of the arrangement of this scanner M6000.

As shown in FIGS. 6A and 6B, a scanner holder M6001 has a box-like shape and contains optical systems and processing circuits necessary for reading. A scanner read lens M6006 is placed in a portion which faces the surface of an original when this scanner M6000 is mounted on the carriage M4001. This scanner read lens M6006 reads an original image. A scanner illuminating lens M6005 contains a light source (not shown), and light emitted by this light source irradiates an original.

A scanner cover M6003 fixed to the bottom portion of the scanner holder M6001 so fits as to shield the interior of the scanner holder M6001 from light. Louver-like handles formed on the side surfaces of this scanner cover M6003 facilitate attachment to and detachment from the carriage M4001. The external shape of the scanner holder M6001 is substantially the same as the printhead cartridge H1000. So, the scanner holder M6001 can be attached to and detached from the carriage M4001 by operations similar to the printhead cartridge H1000.

Also, the scanner holder M6001 accommodates a board having the processing circuits described above and a scanner contact PCB M6004 connected to this board and exposed to the outside. When the scanner M6000 is mounted on the carriage M4001, this scanner contact PCB M6004 comes in contact with the contact FPC E0011 of the carriage M4001, thereby electrically connecting the board to the control system of the main body via the carriage M4001.

An electric circuit configuration in this embodiment of the present invention will be described next.

FIG. 7 is a view schematically showing the overall arrangement of an electric circuit in this embodiment.

The electric circuit of this embodiment primarily comprises the carriage printed circuit board (CRPCB) E0013, a main PCB (Printed Circuit Board) E0014, and a power supply unit E0015.

The power supply unit is connected to the main PCB E0014 to supply various driving power.

The carriage printed circuit board E0013 is a printed circuit board unit mounted on the carriage M4001 (FIG. 2) and functions as an interface for exchanging signals with the printhead through the contact FPC E0011. Also, on the basis of a pulse signal output from an encoder sensor E0004 in accordance with the movement of the carriage M4001, the carriage printed circuit board E0013 detects changes in the positional relationship between an encoder scale E0005 and the encoder sensor E0004 and outputs a signal to the main PCB E0014 through a flexible flat cable (CRFFC) E0012.

The main PCB is a printed circuit board unit for controlling driving of individual parts of the inkjet printing apparatus of this embodiment. This main PCB has, on the board, I/O ports for, e.g., a paper end sensor (PE sensor) E0007, an ASF sensor E0009, a cover sensor E0022, a parallel interface (parallel I/F) E0016, a serial interface (serial I/F) E0017, the resume key E0019, the LED E0020, the power key E0018, and the buzzer E0021. The main PCB is also connected to a CR motor E0001, an LF motor E0002, and a PG motor E0003 to control driving of these motors. Additionally, the main PCB has interfaces connecting to an ink end sensor E0006, a GAP sensor E0008, a PG sensor E0010, a CRFFC E0012, and the power supply unit E0015.

Figure 8:
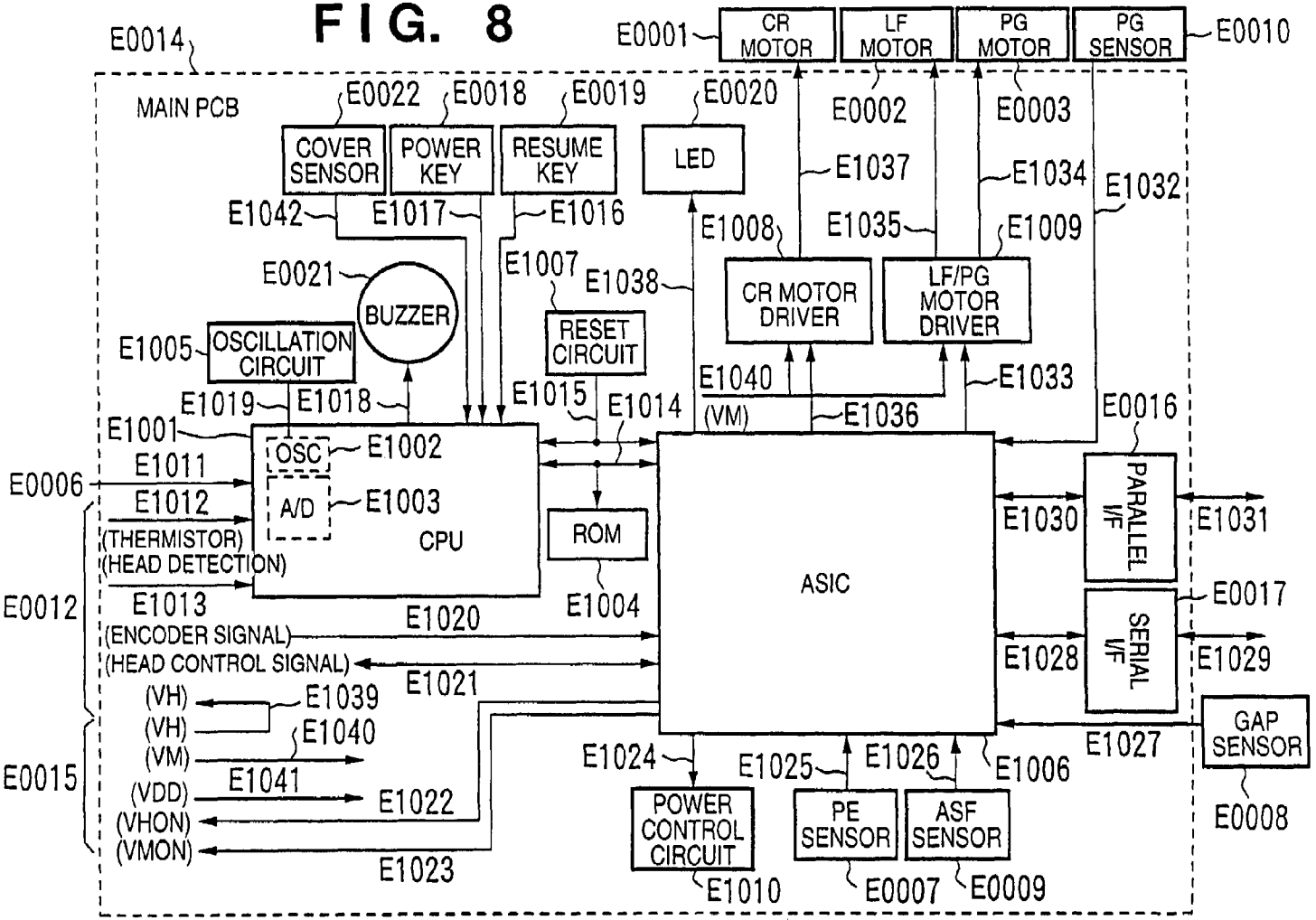
FIG. 8 is a block diagram showing the internal arrangement of a main PCB shown in FIG. 7.

FIG. 8 is a block diagram showing the internal arrangement of the main PCB.

Referring to FIG. 8, a CPU E1001 internally has an oscillator OSC E1002 and is connected to an oscillation circuit E1005 to generate a system clock by an output signal E1019 from the oscillation circuit E1005. Also, the CPU E1001 is connected to a ROM E1004 and an ASIC (Application Specific Integrated Circuit) E1006. In accordance with programs stored in the ROM E1004, the CPU E1001 controls the ASIC and senses the statuses of an input signal E1017 from the power key, an input signal E1016 from the resume key, a cover sensing signal E1042, and a head sensing signal (HS-ENS) E1013. Additionally, the CPU E1001 drives the buzzer E0021 by a buzzer signal (BUZ) E1018 and senses the statuses of an ink end sensing signal (INKS) E1011 and a thermistor temperature sensing signal (TH) E1012 connected to a built-in A/D converter E1003. Furthermore, the CPU E1001 controls driving of the inkjet printing apparatus by performing various logic operations and condition judgements.

The head sensing signal E1013 is a head mounting sensing signal which the printhead cartridge H1000 inputs via the flexible flat cable E0012, the carriage printed circuit board E0013, and the contact flexible print cable E0011. The ink end sensing signal is an output analog signal from the ink end sensor E0006. The thermistor temperature sensing signal E1012 is an analog signal from a thermistor (not shown) formed on the carriage printed circuit board E0013.

A CR motor driver E1008 is supplied with motor power (VM) E1040 as a driving source. In accordance with a CR motor control signal E1036 from the ASIC E1006, the CR motor driver E1008 generates a CR motor driving signal E1037 to drive the CR motor E0001. An LF/PG motor driver E1009 is also supplied with the motor power E1040 as a driving source. In accordance with a pulse motor control signal (PM control signal) E1033 from the ASIC E1006, the LF/PG motor driver E1009 generates an LF motor driving signal E1035 to drive the LF motor and also generates a PG motor driving signal E1034 to drive the PG motor.

A power control circuit E1010 controls power supply to each sensor having a light-emitting element, in accordance with a power control signal E1024 from the ASIC E1006. The parallel I/F E0016 transmits a parallel I/F signal E1030 from the ASIC E1006 to a parallel I/F cable E1031 connected to the outside, and transmits signals from this parallel I/F cable E1031 to the ASIC E1006. The serial IF E0017 transmits a serial I/F signal E1028 from the ASIC E1006 to a serial I/F cable E1029 connected to the outside, and transmits signals from this cable E1029 to the ASIC E1006.

The power supply unit E0015 supplies head power (VH) E1039, the motor power (VM) E1040, and logic power (VDD) E1041. A head power ON signal (VHON) E1022 and a motor power ON signal (VMOM) E1023 from the ASIC E1006 are input to the power supply unit E0015 to control ON/OFF of the head power E1039 and the motor power E1040, respectively. The logic power (VDD) E1041 supplied from the power supply unit E0015 is subjected to voltage transformation where necessary and supplied to individual units inside and outside the main PCB E0014.

The head power E1039 is smoothed on the main PCB E0014, supplied to the flexible flat cable E0011, and used to drive the printhead cartridge H1000.

A reset circuit E1007 detects a decrease in the logic power-supply voltage E1040 and supplies a reset signal (RESET) E1015 to the CPU E1001 and the ASIC E1006 to initialize them.

This ASIC E1006 is a one-chip semiconductor integrated circuit which is controlled by the CPU E1001 via a control bus E1014, outputs the CR motor control signal E1036, the PM control signal E1033, the power control signal E1024, the head power ON signal E1022, and the motor power ON signal E1023, and exchanges signals with the parallel I/F E10016 and the serial I/F E0017. Also, the ASIC E1006 senses the statuses of a PE sensing signal (PES) E1025 from the PE sensor E0007, an ASF sensing signal (ASFS) E1026 from the ASF sensor E0009, a GAP sensing signal (GAPS) E1027 from the GAP sensor E0008, and a PG sensing signal (PGS) E1032 from the PG sensor E0010, and transmits data indicating the statuses to the CPU E1001 through the control bus E1014. On the basis of the input data, the CPU E1001 controls driving of the LED driving signal E1038 to turn on and off the LED E0020.

Furthermore, the ASIC E1006 senses the status of an encoder signal (ENS) E1020 to generate a timing, signal and interfaces with the printhead cartridge H1000 by a head control signal E1021, thereby controlling a printing operation. The encoder signal (ENC) E1020 is an output signal from the CR encoder sensor E0004, that is input through the flexible flat cable E0012. The head control signal E1021 is supplied to the printhead cartridge E1000 through the flexible flat cable E0012, the carriage printed circuit board E0013, and the contact FPC E0011.

Figure 9:
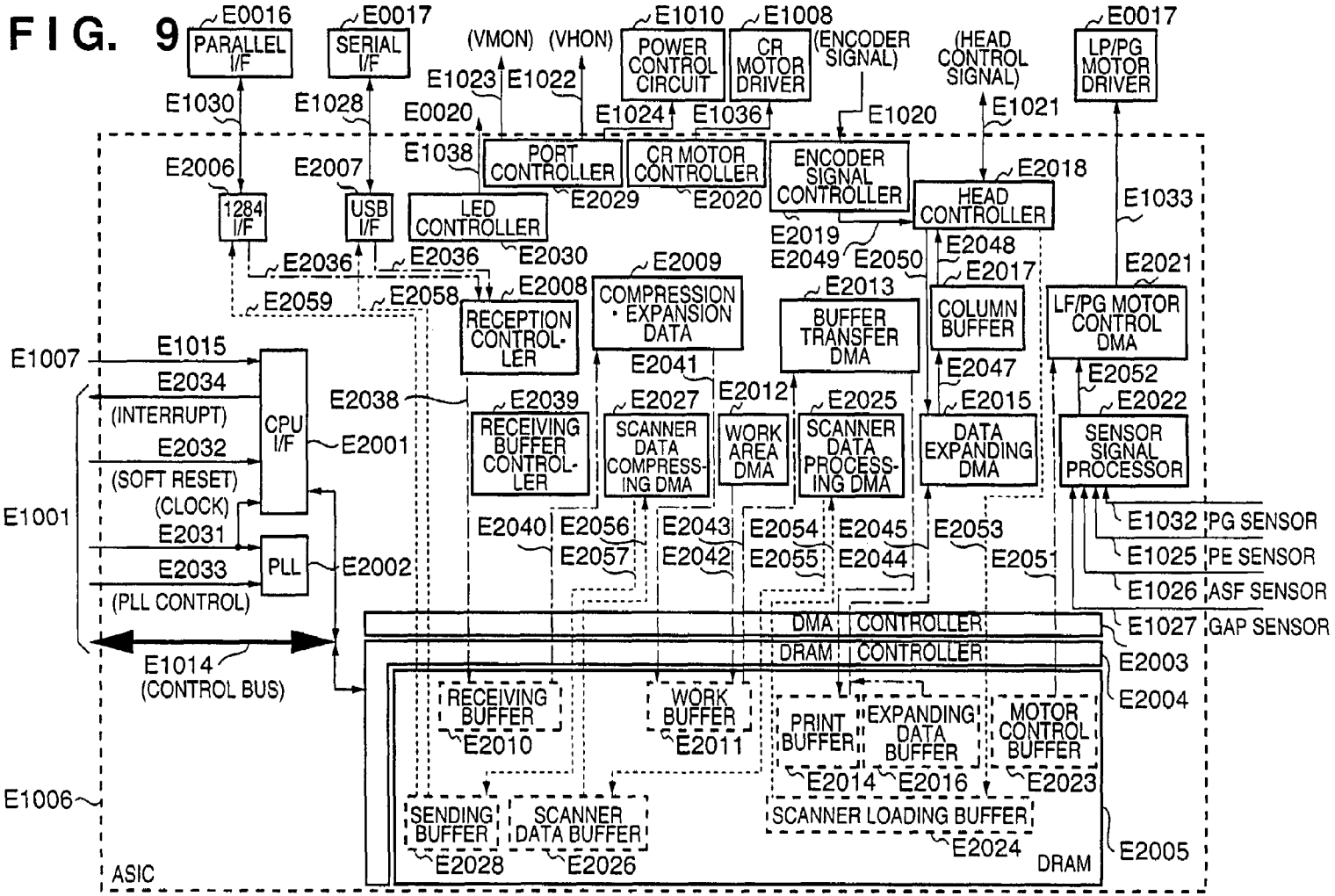
FIG. 9 is a block diagram showing the internal arrangement of an ASIC shown in FIG. 8.

FIG. 9 is a block diagram showing the internal arrangement of the ASIC E1006.

Referring to FIG. 9, only flows of data, such as printing data and motor control data, pertaining to control of the head and each mechanical part are shown in connections between individual blocks. Control signals and clocks concerning read and write of a built-in register in each block and control signals related to DMA control are omitted to avoid the complexity of description in the drawing.

As shown in FIG. 9, a PLL E2002 generates a clock (not shown) to be supplied to the most part of the ASIC E1006, in accordance with a clock signal (CLK) E2031 and PLL control signal (PLLON) E2033 output from the CPU E1001.

A CPU interface (CPU I/F) E2001 controls read and write to a register in each block (to be described below), supplies clocks to some blocks, and accepts an interrupt signal (none of these functions is shown), in accordance with the reset signal E1015, a soft reset signal (PDWN) E2032 and the clock signal (CLK) E2031 output from the CPU E1001, and a control signal from the control bus E1014. This CPU I/F E2001 outputs an interrupt signal (INT) E2034 to the CPU E1001 to inform the CPU E1001 of generating an interrupt in the ASIC E1006.

A DRAM E2005 has areas such as a receiving buffer E2010, work buffer E2011, print buffer E2014, and expanding data buffer E2016, as printing data buffers, and also has a motor control buffer E2023 for motor control. In addition to these printing data buffers, the DRAM E2005 has areas such as a scanner loading buffer E2024, scanner data buffer E2026, and sending buffer E2028, as buffers for use in a scanner operation mode.

This DRAM E2005 is also used as a work area necessary for the operation of the CPU E1001. That is, a DRAM controller E2004 switches between access from the CPU E1001 to the DRAM E2005 using the control bus and access from a DMA controller E2003 (to be described below) to the DRAM E2005, thereby performing read and write to the DRAM E2005.

The DMA controller E2003 accepts a request (not shown) from each block and outputs, to the RAM controller, an address signal and a control signal (neither is shown), or write data (E2038, E2041, E2044, E2053, E2055, or E2057) when a write operation is to be performed, thereby performing DRAM access. When a read operation is to be performed, the DMA controller E2003 transfers readout data (E2040, E2043, E2045, E2051, E2054, E2056, E2058, or E2059) from the DRAM controller E2004 to the block which has requested.

A 1284 I/F E2006 interfaces by two-way communication with an external host apparatus (not shown) through the parallel I/F E0016 under the control of the CPU E1001 via the CPU I/F E2001. Also, when printing is to be performed, the 1284 I/F E2006 transfers received data (PIF received data E2036) from the parallel I/F E0016 to a reception controller E2008 by DMA processing. When scanner read is to be performed, the 1284 I/F E2006 transmits data (1284 transmission data (RDPIF) E2059) stored in the sending buffer E2028 in the DRAM E2005 to the parallel I/F by DMA processing.

A USB I/F E2007 interfaces by two-way communication with an external host apparatus (not shown) through the serial I/F E0017 under the control of the CPU E1001 via the CPU I/F E2001. Also, when printing is to be performed, the USB I/F E2007 transfers received data (USB received data E2037) from the serial I/F E0017 to the reception controller E2008 by DMA processing. When scanner read is to be performed, the USB I/F E2007 transmits data (USB transmission data (RDPIF) E2058) stored in the sending buffer E2028 in the DRAM E2005 to the serial I/F by DMA processing. The reception controller E2008 writes received data (WDIF) E2038) from a selected one of the 1284 I/F E2006 and the USB I/F E2007 into a receiving buffer write address managed by a receiving buffer controller E2039.

A compression/expansion DMA E2009 reads out, under the control of the CPU E1001 via the CPU I/F E2001, received data (raster data) stored on the receiving buffer E2010 from a receiving buffer read address managed by the receiving buffer controller E2039, compresses or expands readout data (RDWK) E2040 in accordance with a designated mode, and writes the data as a printing code string (WDWK) E2041 in the work buffer area.

A printing buffer transfer DMA E2013 reads out, under the control of the CPU E1001 via the CPU I/F E2001, printing codes (RDWP) E2043 on the work buffer E2011, rearranges each printing code into an address on the print buffer E2014, which is suitable for the order of data transfer to the printhead cartridge H1000, and transfers the code (WDWP E2044). A work clear DMA E2012 repeatedly transfers and writes, under the control of the CPU E1001 via the CPU I/F E2001, designated work file data (WDWF) E2042 in a region on the work buffer to which the data is completely transferred by the printing buffer transfer DMA E2015.

A printing data expanding DMA E2015 reads out, under the control of the CPU E1001 via the CPU I/F E2001, the printing codes rearranged and written on the print buffer and expanding data written on the expanding data buffer E2016, by using a data expansion timing signal E2050 from a head controller E2018 as a trigger, thereby generating expanded printing data (WDHDG) E2045, and writes the generated data as column buffer write data (WDHDG) E2047 in a column buffer E2017. This column buffer E2017 is an SRAM for temporarily storing data (expanded printing data) to be transferred to the printhead cartridge H1000. The column buffer E2017 is shared and managed by the printing data expanding DMA and the head controller in accordance with a handshake signal (not shown) of these two blocks.

Under the control of the CPU E1001 via the CPU I/F E2001, this head controller E2018 interfaces with the printhead cartridge H1000 or the scanner via a head control signal. In addition, on the basis of a head driving timing signal E2049 from an encoder signal processor E2019, the head controller E2018 outputs a data expansion timing signal E2050 to the printing data expanding DMA.

When printing is to be performed, the head controller E2018 reads out expanded printing data (RDHD) E2048 from the column buffer in accordance with the head driving timing signal E2049. The head controller E2018 outputs the readout data to the printhead cartridge H1000 via the head control signal E1021.

In a scanner read mode, the head controller E2018 transfers loaded data (WDHD) E2053 input via the head control signal E1021 to the scanner loading buffer E2024 on the DRAM E2005 by DMA transfer. A scanner data processing DMA E2025 reads out, under the control of the CPU E1001 via the CPU I/F E2001, loading buffer readout data (RDAV) E2054 stored in the scanner loading buffer E2024 into a scanner data buffer E2026 on the DRAM E2005 and writes processed data (WDAV) E2055, subjected to processing such as averaging, into the scanner data buffer E2016 on the DRAM E2005.

A scanner data compressing DMA E2027 reads out processed data (RDYC) E2056 on the scanner data buffer E2026, compresses the data, and writes compressed data (WDYC) E2057 in the sending buffer E2028, under the control of the CPU E1001 via the CPU I/F E2001.

The encoder signal processor E2019 receives an encoder signal (ENC) and outputs the head driving timing signal E2049 in accordance with a mode determined by the control of the CPU E1001. In addition, the encoder signal processor E2019 stores information concerning the position or speed of the carriage M4001, obtained from the encoder signal E1020, into a register and provides the information to the CPU E1001. On the basis of this information, the CPU E1001 determines various parameters for controlling the CR motor E0001. A CR motor controller E2020 outputs a CR motor control signal E1036 under the control of the CPU E1001 via the CPU I/F E2001.

A sensor signal processor E2022 receives output sensing signals from, e.g., the PG sensor E0010, the PE sensor E0007, the ASF sensor E0009, and the GAP sensor E0008, and transmits these pieces of sensor information to the CPU E1001 in accordance with a mode determined by the control of the CPU E1001. The sensor signal processor E2022 also outputs a sensor signal E2052 to an LF/PG motor control DMA E2021.

Under the control of the CPU E1001 via the CPU I/F E2001, this LF/PG motor control DMA E2021 reads out a pulse motor driving table (RDPM) E2051 from a motor control buffer E2023 on the DRAM E2005 and outputs a pulse motor control signal E. In addition, the LF/PG motor control DMA E2021 outputs a pulse motor control signal E1033 by using the abovementioned sensor signal as a trigger of the control.

An LED controller E2030 outputs an LED driving signal E1038 under the control of the CPU E1001 via the CPU I/F E2001. A port controller E2029 outputs the head power ON signal E1022, the motor power ON signal E1023, and the power control signal E1024 under the control of the CPU E1001 via the CPU I/F E2001.

Figure 10:
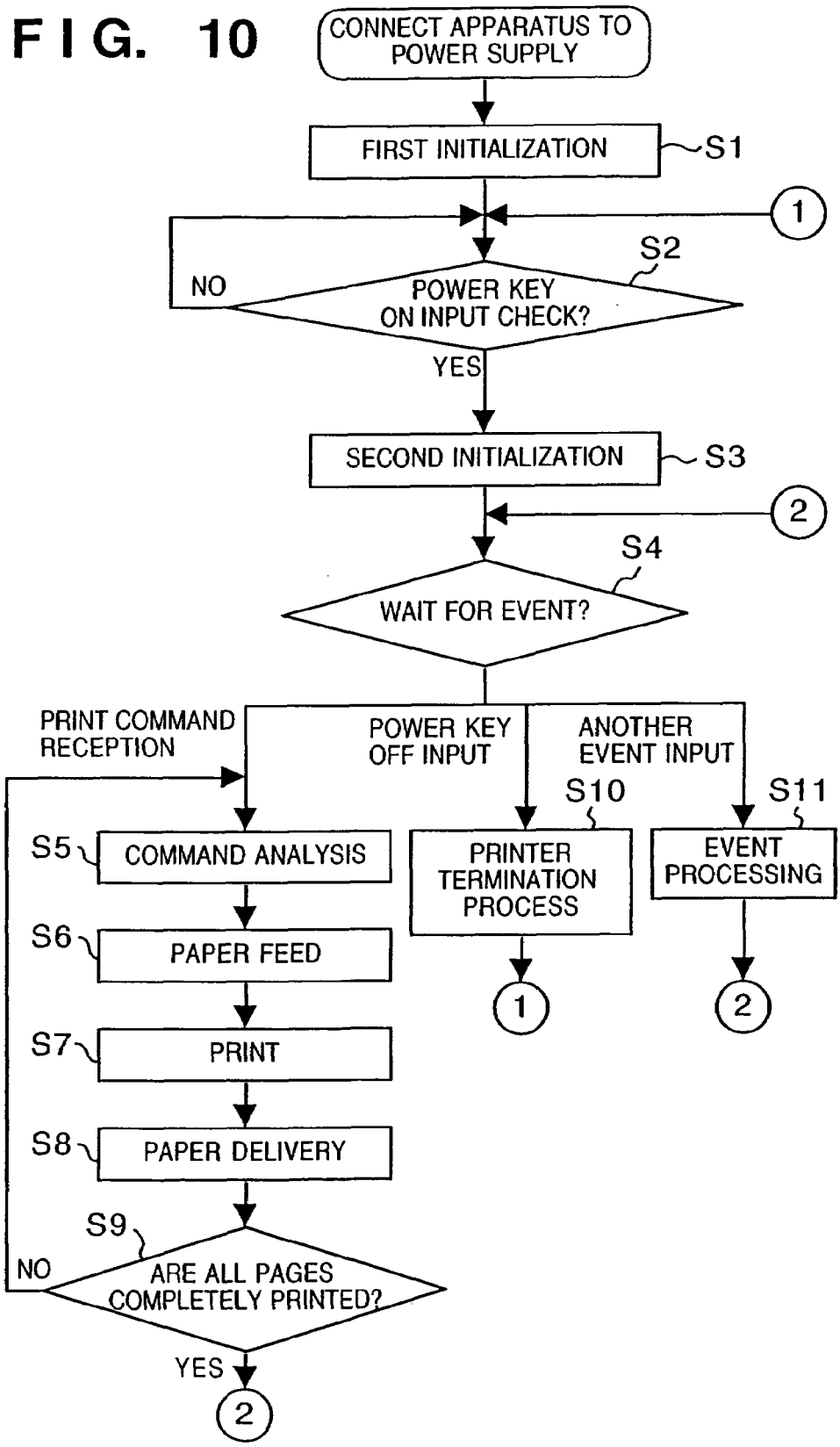
FIG. 10 is a flow chart showing the operation of the embodiment of the present invention.

The operation of the inkjet printing apparatus of this embodiment of the present invention constructed as above will be described below with reference to a flow chart in FIG. 10.

When this apparatus is connected to the AC power supply, in step S1 first initialization is performed for the apparatus. In this initialization, the electric circuit system including, e.g., the ROM and RAM of this apparatus is checked, thereby checking whether the apparatus can normally operate electrically.

In step S2, whether the power key E0018 on the upper case M1002 of the apparatus main body M1000 is pressed is checked. If the power key E0018 is pressed, the flow advances to step S3 to perform second initialization.

In this second initialization, the various driving mechanisms and the head system of this apparatus are checked. That is, whether the apparatus is normally operable is checked in initializing the various motors and loading head information.

In step S4, an event is waited for. That is, a command event from the external I/F, a panel key event by a user operation, or an internal control event with respect to this apparatus is monitored. If any of these events occurs, processing corresponding to the event is executed.

For example, if a printing command event is received from the external I/F in step S4, the flow advances to step S5. If a power key event by a user operation occurs in step S4, the flow advances to step S10. If another event occurs in step S4, the flow advances to step S11.

In step S5, the printing command from the external I/F is analyzed to determine the designated paper type, sheet size, printing quality, and paper feed method. Data indicating these determination results is stored in the RAM E2005 of the apparatus, and the flow advances to step S6.

In step S6, paper feed is started by the paper feed method designated in step S5. When the sheet is fed to a printing start position, the flow advances to step S7.

In step S7, printing is performed. In this printing, printing data supplied from the external I/F is once stored in the printing buffer. Subsequently, the CR motor E0001 is driven to start moving the carriage M4001 in the scanning direction, and the printing data stored in the print buffer E2014 is supplied to the printhead cartridge H1000 to print one line. When the printing data of one line is completely printed, the LF motor E0002 is driven to rotate an LF roller M3001 to feed the sheet in the sub-scan direction. After that, the above operation is repeatedly executed. When printing of the printing data of one page supplied from the external I/F is completed, the flow advances to step S8.

In step S8, the LF motor E0002 is driven to drive a sheet delivery roller M2003. Sheet feed is repeated until it is determined that the sheet is completely delivered from this apparatus. When this operation is completed, the sheet is completely delivered onto the sheet delivery tray M1004*a*.

In step S9, whether printing of all pages to be printed is completed is checked. If pages to be printed remain, the flow returns to step S5 to repeat the operation in steps S5 to S9 described above. When printing of all pages to be printed is completed, the printing operation is completed. After that, the flow returns to step S4 to wait for the next event.

In step S10, a printer termination process is performed to stop the operation of this apparatus. That is, to shut off the power supply to the various motors and the head, the operation transits to a state in which the power supply can be shut off. After that, the power supply is shut off, and the flow returns to step S4 to wait for the next event.

In step S11, event processing other than the above is performed. For example, processing corresponding to any of the diverse panel keys of this apparatus, a recovery command from the external I/F, or an internally occurring recovery event is performed. After the processing, the flow advances to step S4 to wait for the next event.

A printhead H1001 mounted in the above printing apparatus will be described below.

At first, an example of a printing element substrate having an analog circuit for obtaining information and a digital circuit in a mixed arrangement each powered by different voltages, which have been developed in recent years is described in detail.

Figure 15:
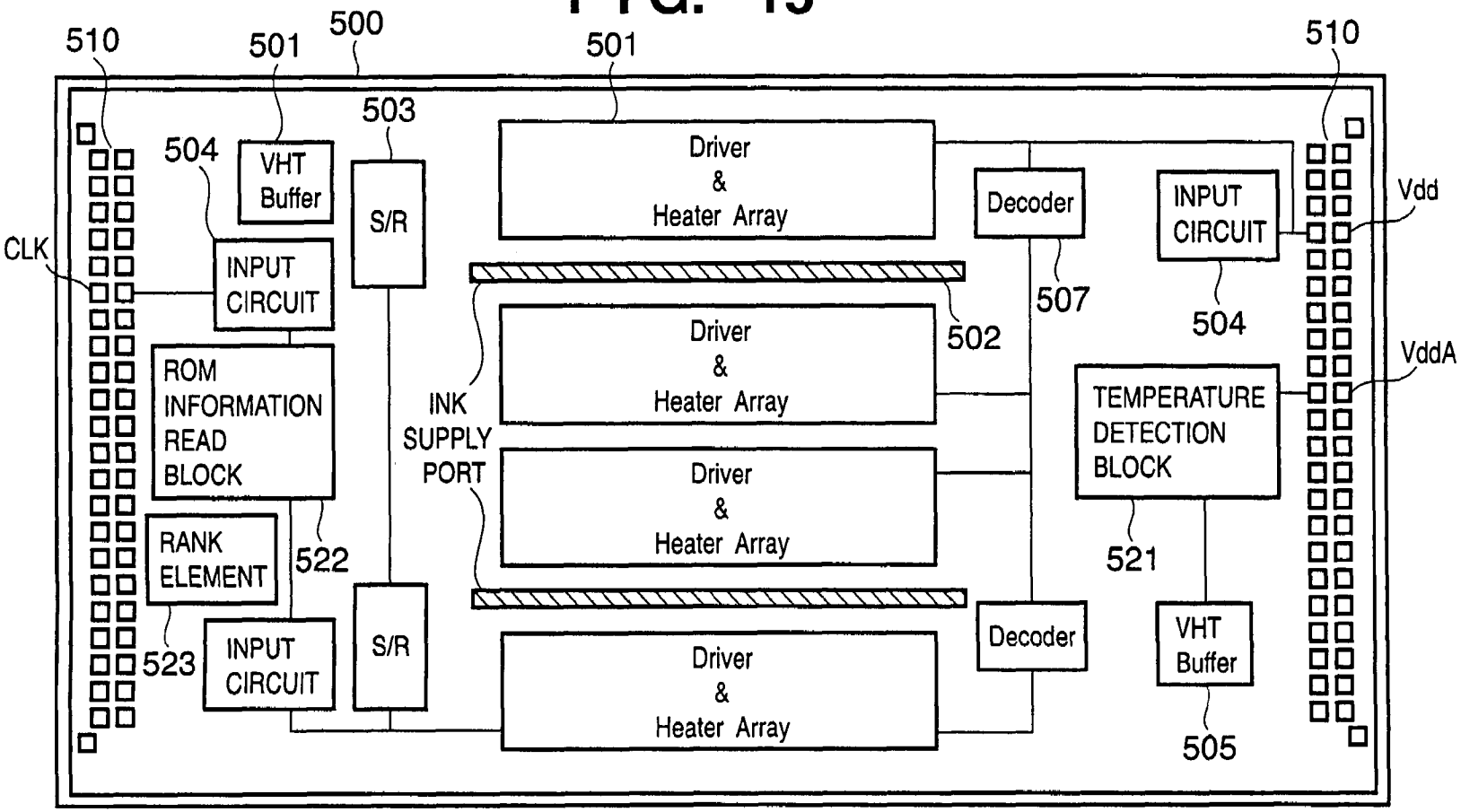
FIG. 15 is a block diagram showing the circuit arrangement of a printhead.

FIG. 15 is a block diagram of an inkjet printhead including a circuit for outputting the information of a detected temperature as a digital signal. Referring to FIG. 15, reference numeral 500 denotes a printing element substrate on which heaters and drive circuits are integrally formed by a semiconductor process; 502, an ink supply port for supplying ink from the lower surface of the substrate; 501, a driver/heater array with a plurality of heaters and driver circuits arrayed; 503, a shift register for temporarily holding print data to be printed; 507, a decoder circuit for selectively driving a desired heater block in the driver/heater array; 504, an input circuit which includes a buffer and inputs a digital signal to the shift register and decoder; 510, an input terminal; 521, a temperature detection block for detecting the substrate temperature, converting the information into a digital signal and outputting the signal; 522, a ROM information read block for ranking information unique to the substrate, e.g., the heater resistance value or the ON resistance value of a driver transistor, writing the information in a nonvolatile memory (ROM) (not shown) arranged on the same substrate, and reading the information as needed; 523, a rank element for measuring the unique information to be written in the ROM, e.g., the heater resistance value or the ON resistance value of a transistor; and 505, a power supply buffer circuit for supplying a gate voltage to a transistor in the driver/heater array 501.

Figure 16A:
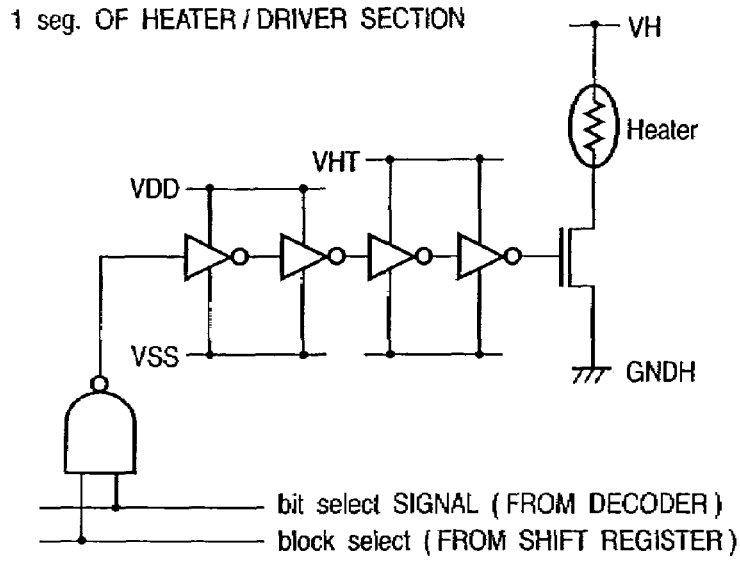
FIGS. 16A and 16B are circuit diagrams showing the arrangements of the respective portions in FIG. 15.
Figure 16B:
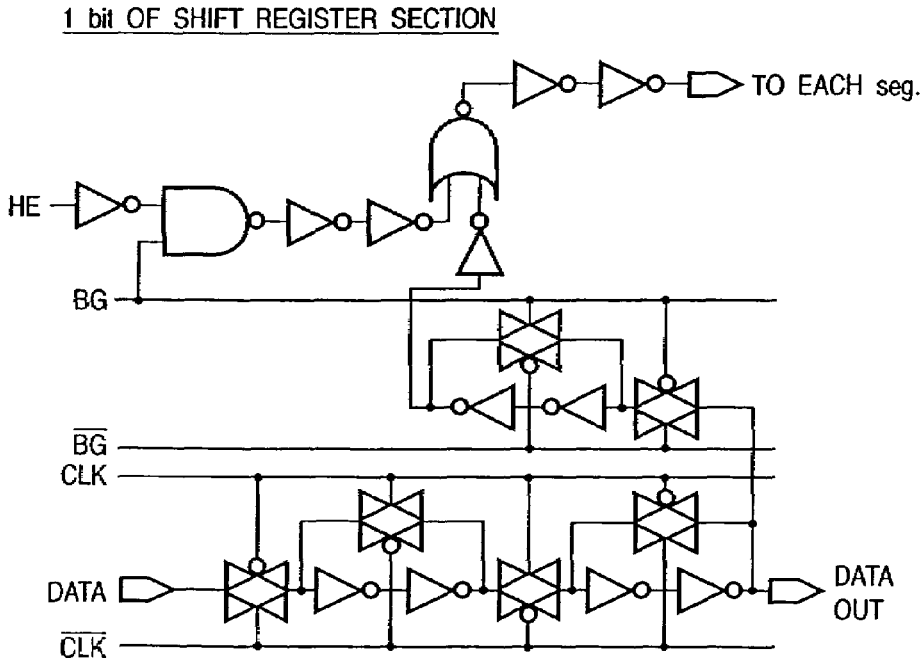
Figure 17:
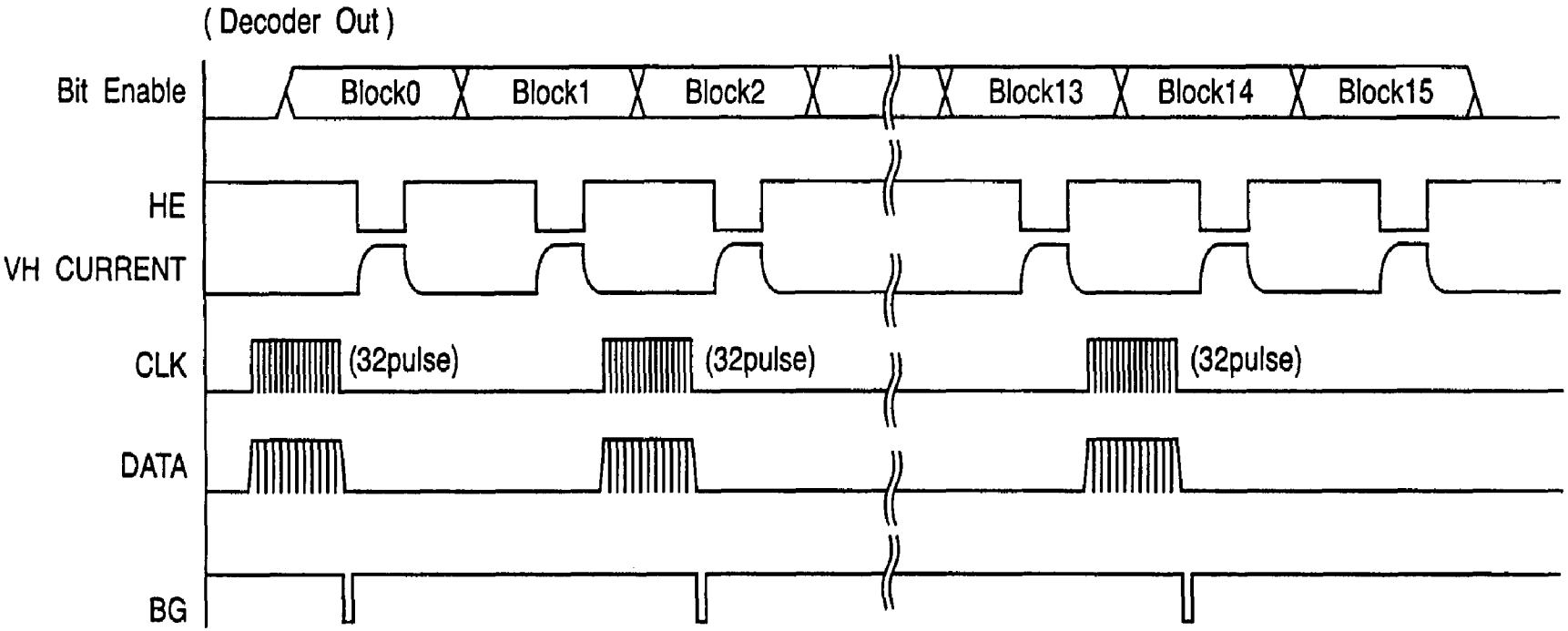
FIG. 17 is a timing chart showing signal states at the respective portions in FIG. 15.

FIG. 16A is a circuit diagram showing an equivalent circuit corresponding to one segment of the driver/heater array 501. FIG. 16B is a circuit diagram showing an equivalent circuit corresponding to one bit of the shift register 503. FIG. 17 is a timing chart showing signal states at the respective portions from the shift register to the heater. A series of operations after print information is sent to the shift register until a current is supplied to the heater to drive the printhead will be described below with reference to FIGS. 16A, 16B, and 17.

Print data is supplied to a DATA terminal in synchronism with a clock pulse applied to a CLK terminal. The shift register temporarily stores the print data, and a latch circuit holds the data in accordance with a latch signal supplied to a BG terminal. After that, a logical product of a Block selection signal for selecting heaters divided into desired blocks and the print data held by the latch circuit is obtained in a matrix, and a heater current flows in synchronism with an HE signal that directly determines the current drive time. The series of operations are repeated for each of blocks 0 to 15, thereby printing the data.

Figure 18:
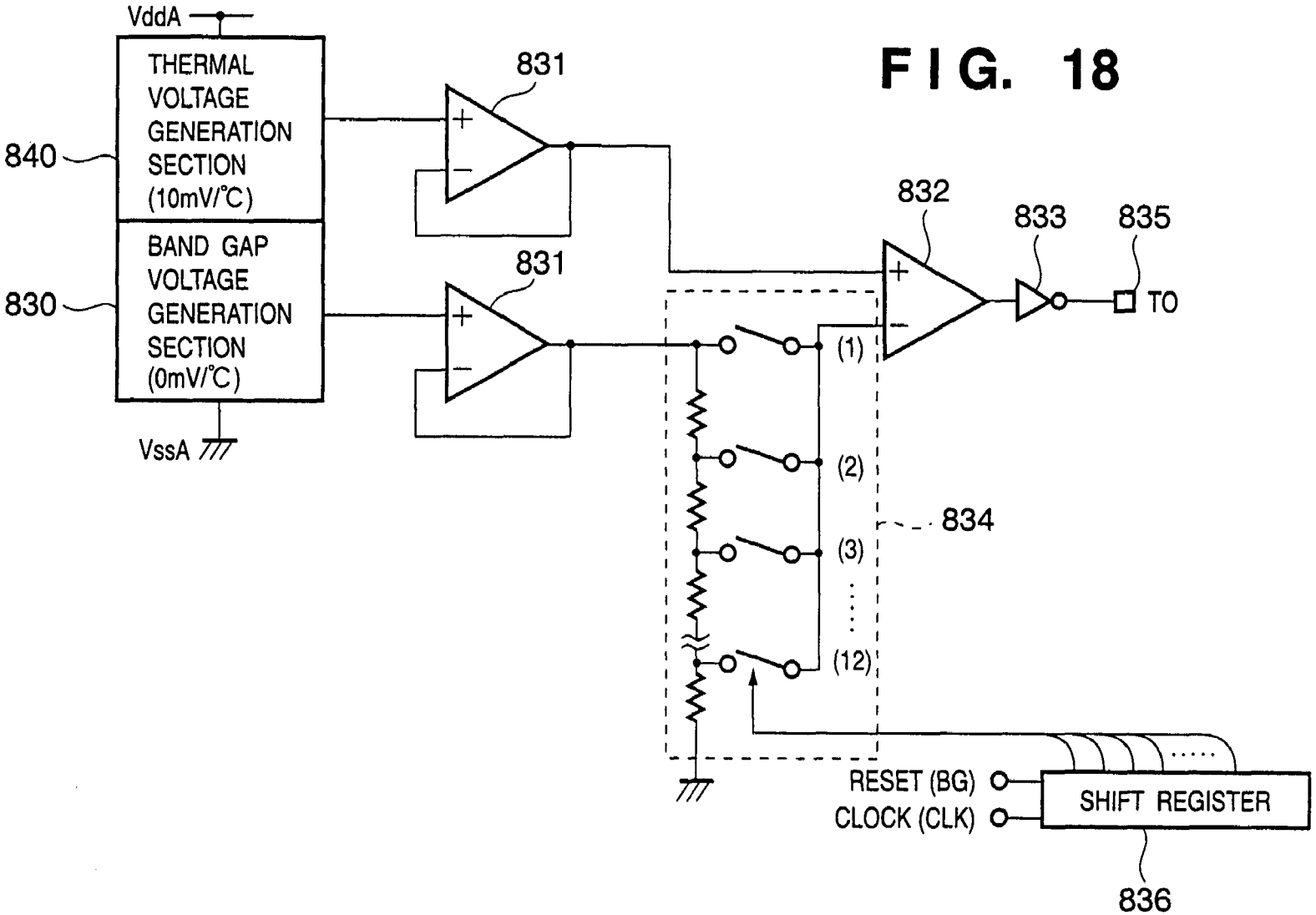
FIG. 18 is a circuit diagram showing the arrangement of a temperature detection block shown in FIG. 15.
Figure 19:
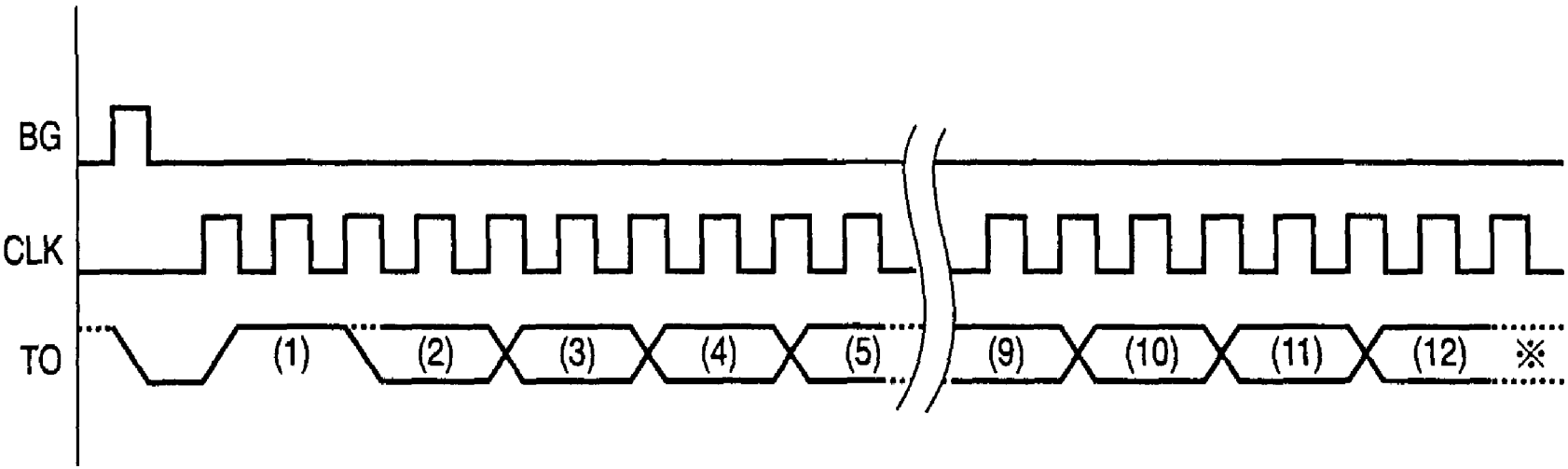
FIG. 19 is a timing chart of the temperature detection block shown in FIG. 18.

FIG. 18 is a block diagram showing the arrangement of the temperature detection block 521 for detecting the temperature of the printing element substrate 500 and outputting the information as a digital signal. FIG. 19 is a timing chart showing a clock CLK and signal states at an output TO of the temperature detection block 521. The operation of the temperature detection block 521 will be described below with reference to FIGS. 18 and 19.

As shown in FIG. 18, the temperature detection block 521 has a thermal voltage generation section 840 for generating a voltage having an almost linear characteristic with respect to the temperature, and a band gap voltage generation section 830 for generating a voltage that changes little with respect to the temperature. The outputs from these sections pass through buffer circuits 831 and are compared by a comparator 832, thereby outputting temperature information from a TO terminal 835. A voltage generation block 834 is formed from dividing resistors and analog switches to generate a voltage corresponding to the detected temperature on the basis of the band gap voltage.

At this time, the output from the band gap voltage generation section 830 is set to a voltage value, which corresponds to a temperature to be detected, using the division ratio of the plurality of resistors in the voltage generation block 834, and the analog switches connected to the division points of the resistors are sequentially switched in accordance with an output from a shift register 836 that operates in synchronism with the clock pulse whereby digital signals related to the temperature at a desired resolution are serially output from the TO terminal 835.

OP amplifiers used in the band gap voltage generation section 830, thermal voltage generation section 840, and buffer circuits 831, and the comparator 832 in the circuit block are analog circuits each of which is formed by combining elements such as a transistor, diode, and resistor. Hence, the characteristic of the circuit is determined by the accuracy or voltage dependence of each element.

For this reason, for the analog circuit portion, the specifications must be determined by accurately grasping the element characteristic and taking the use conditions (power supply voltage, noise environment, and the like) into consideration, and the circuit must be designed by predicting the characteristic by a circuit simulation based on the specifications.

As described above, the analog circuit requires the voltage of 5V in order to show the full ability of characteristics of components used therein, and the digital circuit requires the lower voltage of 3.3V in the recent trend. The concrete arrangements of the present invention which have been made under these circumstances will be described hereinafter.

First Embodiment

Figure 11:
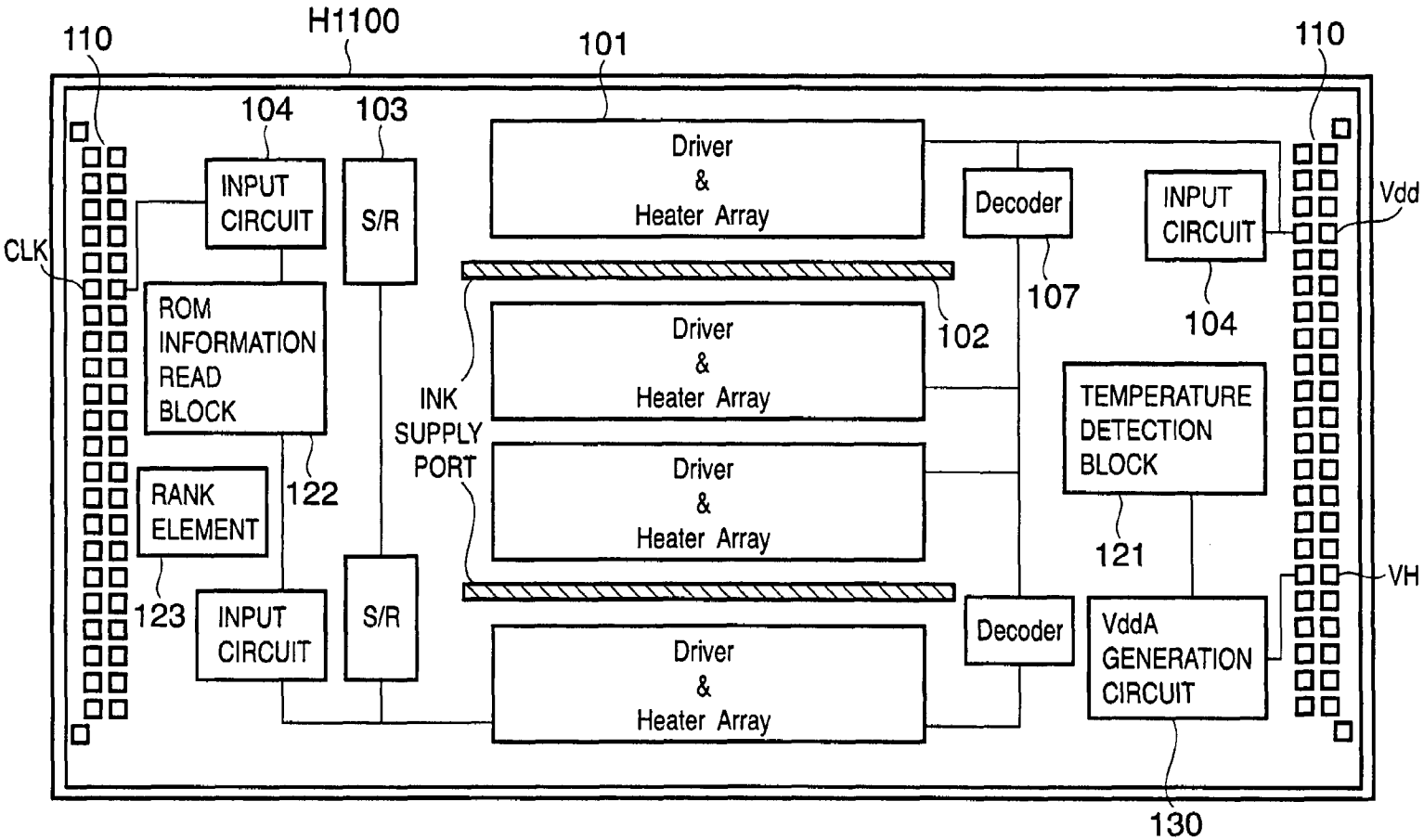
FIG. 11 is a block diagram showing the circuit arrangement of a printhead according to the first embodiment of the present invention.

FIG. 11 is a block diagram for explaining the circuit arrangement of the printhead H1001 according to the first embodiment of the present invention. Referring to FIG. 11, reference numeral H1100 denotes a printing element substrate on which heaters and drive circuits are integrally formed by a semiconductor manufacturing process; 102, an ink supply port for supplying ink from the lower surface of the substrate; 101, a driver/heater array with a plurality of heaters and driver circuits arrayed; 103, a shift register for temporarily holding print data to be printed; 107, a decoder circuit for selectively driving a desired heater block in the driver/heater array; 104, an input circuit which includes a buffer and inputs a digital signal to the shift register and decoder; 110, an input terminal; 121, a temperature detection block for detecting the substrate temperature, converting the information into a digital signal and outputting the signal; 122, a ROM information read block for ranking information unique to the substrate, e.g., the heater resistance value or the ON resistance value of a driver transistor, writing the information in a nonvolatile memory (ROM) (not shown) arranged on the same substrate, and reading the information as needed; 123, a rank element for measuring the unique information to be written in the ROM, e.g., the heater resistance value or the ON resistance value of a transistor; and 130, a voltage generation circuit for generating an analog system power supply (VddA) to be supplied to the temperature detection block 121.

In the circuit arrangement of the printing element substrate H1100 of the printhead of this embodiment, a power supply voltage (Vdd) of a digital circuit portion is 3.3 V. The power supply voltage (VddA) of an analog circuit portion for obtaining information is 5 V. Only the power supply voltage (Vdd) of the digital system is externally supplied, except a power supply voltage for the printing element. The power supply voltage (VddA) of the analog system is generated from a heater drive power supply voltage (VH) which is supplied to the heater composing the printing element by the voltage generation circuit 130.

Figure 12:
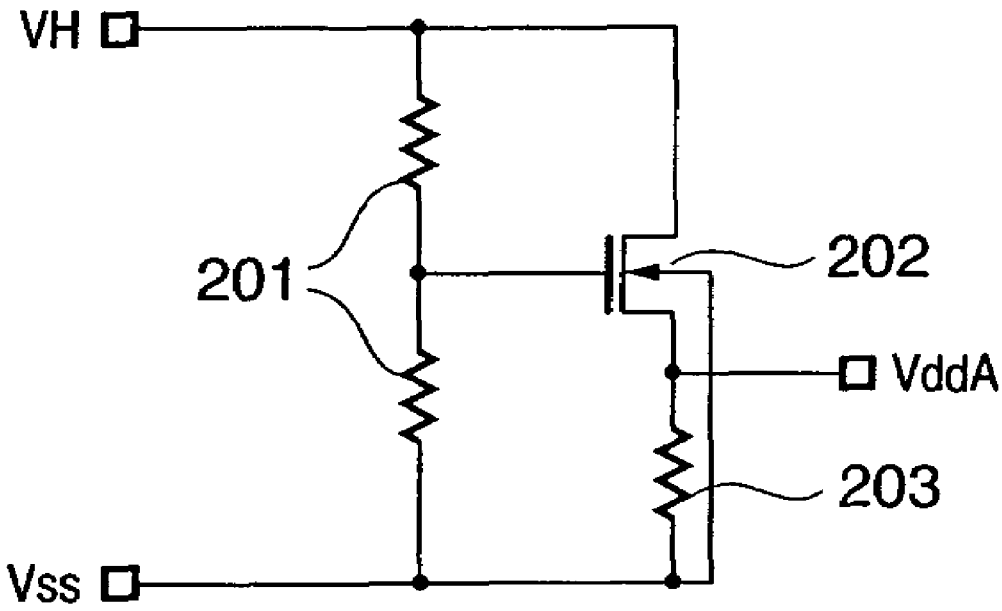
FIG. 12 is a circuit diagram showing an arrangement of a voltage generation circuit shown in FIG. 11.

FIG. 12 is a circuit diagram for explaining the circuit arrangement of the voltage generation circuit 130 in detail. Reference numeral 201 denotes a dividing resistor for generating the voltage VddA (analog system power supply) from a voltage VH; 202, an NMOS transistor that constructs a source follower serving as a buffer; and 203, a load resistor of the source follower.

With this circuit arrangement, the voltage VH is reduced by the ratio of the dividing resistors 201, impedance-converted by the NMOS transistor 202, and output from the VddA terminal. At this time, the voltage is further reduced by a voltage Vth in the gate-to-source path of the source follower 202.

A detailed example will be described. Assume that VH=11 V, and Vth of the source follower 202 is set to 2 V in consideration of the back gate effect. In this case, by setting the ratio of the dividing resistors 201 to 4:7, the voltage at the division point can be set to 7 V, and VddA as the output from the source follower 202 can be set to 5 V.

Figure 13:
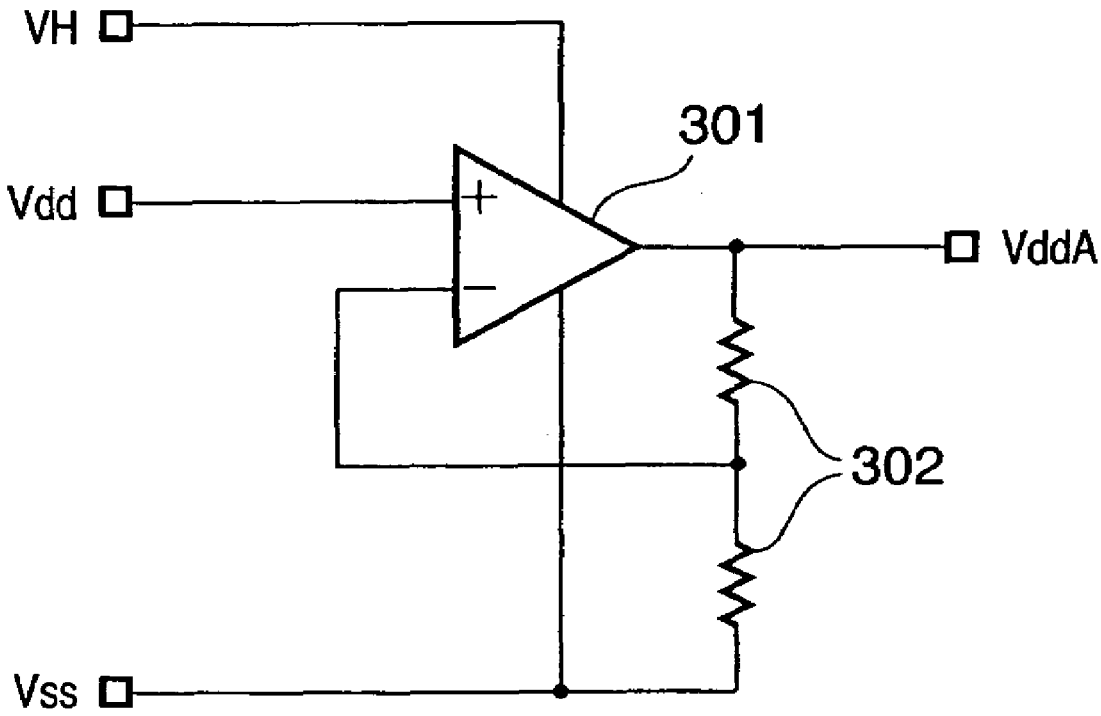
FIG. 13 is a circuit diagram showing another arrangement of the voltage generation circuit shown in FIG. 11.

FIG. 13 is a circuit diagram for explaining another circuit arrangement of the voltage generation circuit 130. Reference numeral 301 denotes an OP amplifier using the VH voltage as a power supply; and 302, a resistor for determining the amplification factor of a noninverting amplifier formed from the OP amplifier 301.

With this circuit arrangement, the logic system power supply voltage (Vdd) is amplified by the noninverting amplifier 301 and output as the VddA voltage.

A concrete example will be described when Vdd=3.3 V, the value of the resistor 302 is determined such that the amplification factor of the noninverting amplifier 301 becomes 1.52, thereby setting the voltage of the output VddA to 5 V.

As described above, according to this embodiment, when a power supply voltage for the analog system for obtaining information except a power supply voltage for printing element and a power supply voltage for logic system are different in value, only the power supply voltage for the logic system is externally supplied, and the power supply voltage for the analog system is internally generated. Since only one type of power supply except a power supply for the printing element is externally supplied to the printhead element substrate, the arrangement can be simplified without increasing the cost of the entire system, and an advantageous arrangement can be obtained from the viewpoint of space saving or energy saving (power consumption).

Second Embodiment

A printhead according to the second embodiment of the present invention will be described below. The same reference numerals as in the first embodiment denote the same parts in the second embodiment, and a description thereof will be omitted.

Figure 14:
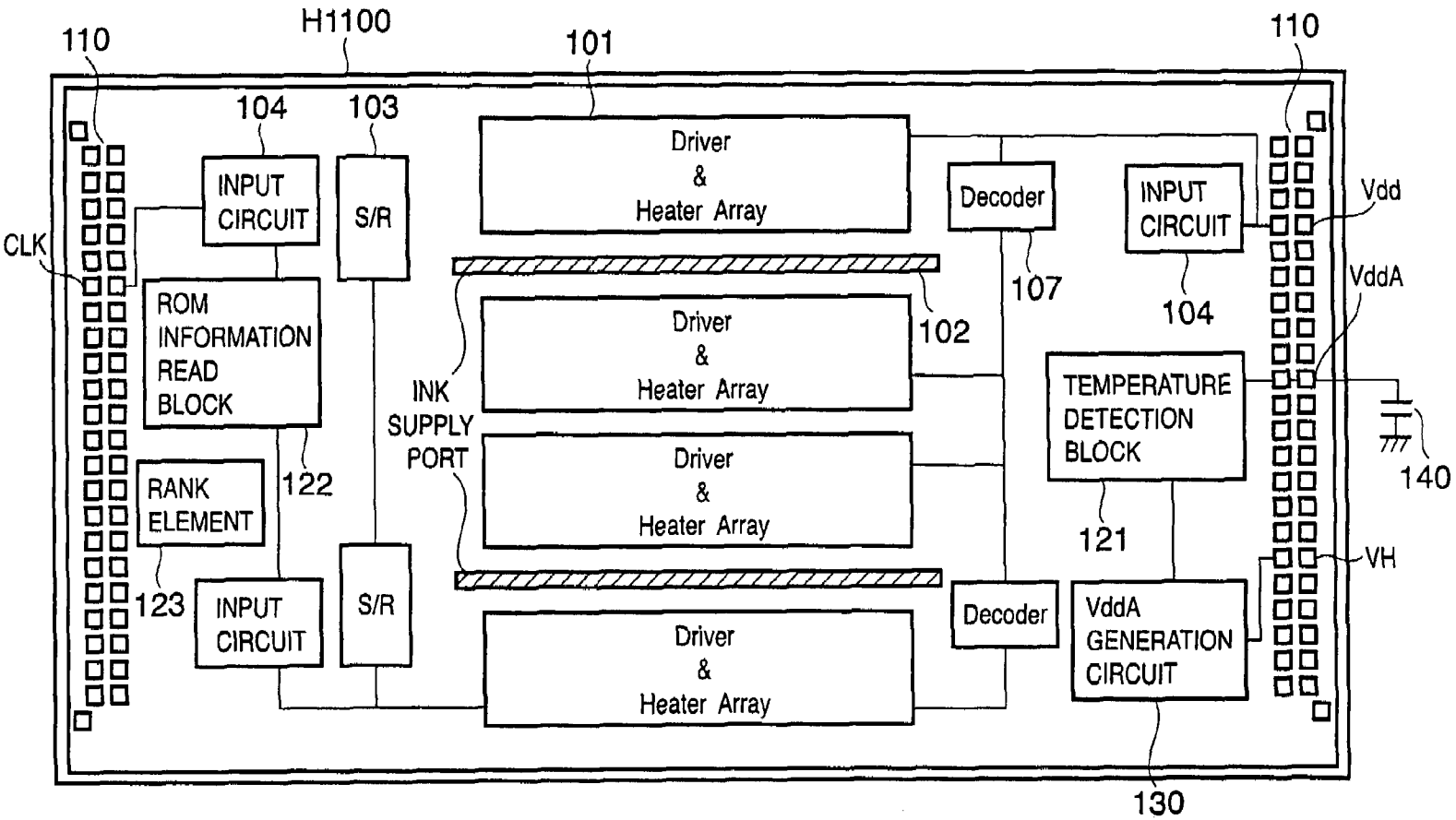
FIG. 14 is a block diagram showing the circuit arrangement of a printhead according to the second embodiment of the present invention.

FIG. 14 is a block diagram showing the circuit arrangement of a printhead according to the second embodiment of the present invention, which is almost the same as that of the first embodiment shown in FIG. 11. The printhead of the this embodiment has a capacitor 140 externally connected to the output of an analog system power supply voltage generation circuit 130, unlike the first embodiment.

The above-described analog system power supply voltage generation circuit 130 shown in FIG. 12 or 13 generates a power supply voltage on the basis of a heater drive power supply voltage VH. Since this voltage VH is a heater drive voltage, large noise is readily generated when a current actually flows to the heater. In addition, the voltage may be affected by noise such as a clock frequency. A voltage VddA generated on the basis of the voltage VH can also have such noise. When the voltage VddA has noise, the circuit operation of the analog system may become unstable, or an operation error may occur.

In this embodiment, to cope with such phenomenon, a terminal for extracting the output of the power supply voltage generation circuit 130 for the analog system for obtaining information is prepared, and an external capacitor is inserted between the output terminal and a Vss (GND) potential.

Other embodiment

The above-described arrangement for reducing noise is especially effective when the frequency of the clock pulse is 5 MHz or more.

In the above embodiments, a substrate temperature has been exemplified as information to be detected by an analog circuit for obtaining information. However, the same effect as described above can be expected not only for the analog circuit but also for an analog circuit for processing a quantity such as a heater resistance value, the resistance value of a driver transistor, the individual value of switching speed, an ink remaining amount, or a protective film thickness.

In the above embodiments, droplets discharged from the printhead are ink droplets, and a liquid stored in the ink tank is ink. However the liquid to be stored in the ink tank is not limited to ink. For example, a treatment solution to be discharged onto a printing medium so as to improve the fixing property or water resistance of a printed image or its image quality may be stored in the ink tank.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printing head, and consequently, a bubble can be formed in the liquid (ink) in one-to-one correspondence with the driving signal.

By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printing head, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printing head having a length corresponding to the width of a maximum printing medium which can be printed by the printer, either the arrangement which satisfies the full-line length by combining a plurality of printing heads as disclosed in the above specification or the arrangement as a single printing head obtained by forming printing heads integrally can be used.

In addition, not only an exchangeable chip type printing head, as described in the above embodiment, which can be electrically connected to the apparatus main unit and can receive an ink from the apparatus main unit upon being mounted on the apparatus main unit but also a cartridge type printing head in which an ink tank is integrally arranged on the printing head itself can be applicable to the present invention.

It is preferable to add recovery means for the printing head, preliminary auxiliary means, and the like provided as an arrangement of the printer of the present invention since the printing operation can be further stabilized. Examples of such means include, for the printing head, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printing head or by combining a plurality of printing heads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention.

In this case, as described in Japanese Patent laid Open No. 54-56847 or Japanese Patent Laid Open No. 60-71260, an ink may be supplied in a form of perforated sheet opposed to the electrothermal transducer in which the ink is maintained in liquid or solid within a dent or a through-hole thereon. In the present invention, the above-mentioned film boiling system is most effective for the above-mentioned inks.

The present invention can be applied to a system constituted by a plurality of devices (e.g., host computer, interface, reader, printer) or to an apparatus comprising a single device (e.g., copying machine, facsimile machine).

As many apparently widely different embodiments of the present invention can be made without departing from the spirit and scope thereof, it is to be understood that the invention is not limited to the specific embodiments thereof except as defined in the appended claims.

What is claimed is:

1. A printhead comprising an element substrate having a printing element, a digital circuit and an analog circuit, said digital circuit being for selectively driving said printing element in accordance with input print data, and said analog circuit including detection means for obtaining information, wherein a value of a voltage for driving said analog circuit is higher than a value of a voltage for driving said digital circuit, and a value of a voltage to be supplied to said printing element is higher than the value of the voltage for driving said analog circuit, and a voltage generation circuit for generating the voltage for driving said analog circuit by using the voltage supplied to said printing element is arranged on said element substrate.

2. The printhead according to claim 1, further comprising a capacitor arranged outside said element substrate and having one terminal connected to the voltage for driving said analog circuit and the other terminal grounded.

3. The printhead according to claim 1, wherein said voltage generation circuit comprises a dividing resistor and a transistor.

4. The printhead according to claim 1, wherein said voltage generation circuit comprises a noninverting amplifier.

5. The printhead according to claim 1, wherein said digital circuit comprises a shift register for temporarily storing the print data and a latch for holding the data stored in said shift register.

6. The printhead according to claim 1, wherein said analog circuit comprises means for detecting an external temperature of said element substrate or means for monitoring a heater resistance value.

7. The printhead according to claim 1, wherein said printhead is an inkjet printhead which ejects ink to print.

8. The printhead according to claim 7, wherein said printing element comprises an electrothermal transducer for generating thermal energy to be applied to the ink so as to eject the ink using the thermal energy.

9. The printhead according to claim 8, wherein said detection means detects a temperature of said element substrate.

10. The printhead according to claim 8, wherein said digital circuit comprises a memory for storing at least one of pieces of information related to a resistance value of said electrothermal transducer, a resistance value upon driving of said printing element, and a thickness of each layer of said element substrate.

11. The printhead according to claim 1, wherein the value of the voltage for driving said digital circuit is 3.3 V, and the value of the voltage for driving said analog circuit is 5 V.

12. A printing apparatus for printing using a printhead, wherein the printhead comprises an element substrate having a printing element, a digital circuit and an analog circuit, said digital circuit being for selectively driving said printing element in accordance with input print data, and said analog circuit including detection means for obtaining information, a value of a voltage for driving said analog circuit is higher than a value of a voltage for driving said digital circuit, and a value of a voltage to be supplied to said printing element is higher than the value of the voltage for driving said analog circuit, a voltage generation circuit for generating the voltage for driving said analog circuit by using the voltage supplied to said printing element is arranged on said element substrate, and the printing apparatus comprises a power source circuit for supplying to the printhead the voltage to be supplied to said printing element and the voltage for driving said analog circuit.

13. The printhead according to claim 1, wherein an output of said voltage generation circuit is connected to a capacitor.

14. The printhead according to claim 1, wherein the voltage to be supplied to said printing element and the voltage for driving said analog circuit are supplied to said printhead from outside of said printhead.

* * * * *